US011564516B2

(12) United States Patent
Jäger et al.

(10) Patent No.: US 11,564,516 B2
(45) Date of Patent: Jan. 31, 2023

(54) DRINKING DEVICE

(71) Applicant: AIR UP GROUP GmbH, Munich (DE)

(72) Inventors: Tim Jäger, Munich (DE); Magdalena Jüngst, Munich (DE); Jannis Koppitz, Munich (DE); Fabian Schlang, Munich (DE)

(73) Assignee: air up group GmbH, Munich (DE)

( * ) Notice: Subject to any disclaimer, the term of this patent is extended or adjusted under 35 U.S.C. 154(b) by 181 days.

(21) Appl. No.: 16/631,432

(22) PCT Filed: Jul. 13, 2018

(86) PCT No.: PCT/EP2018/069108
§ 371 (c)(1),
(2) Date: Jan. 15, 2020

(87) PCT Pub. No.: WO2019/016096
PCT Pub. Date: Jan. 24, 2019

(65) Prior Publication Data

US 2020/0178712 A1 Jun. 11, 2020

(30) Foreign Application Priority Data

Jul. 20, 2017 (DE) ..... 102017212472.5
Oct. 18, 2017 (DE) ..... 102017009718.6
May 5, 2018 (DE) ..... 102018003669.4

(51) Int. Cl.
*A47G 19/22* (2006.01)
*A47G 19/12* (2006.01)
(Continued)

(52) U.S. Cl.
CPC ..... *A47G 19/12* (2013.01); *A47G 19/2205* (2013.01); *B65D 23/12* (2013.01);
(Continued)

(58) Field of Classification Search
CPC ..... A61J 1/2093; A61J 1/202; A61J 1/2024; A61J 1/2027; B65D 81/3211;
(Continued)

(56) References Cited

U.S. PATENT DOCUMENTS 5,635,229 A 6/1997 Ray
6,502,712 B1 * 1/2003 Weber-Unger .... A47G 19/2205 220/501
(Continued)

FOREIGN PATENT DOCUMENTS

CN 2389124 Y 7/2000
CN 2461872 Y 11/2001
(Continued)

OTHER PUBLICATIONS

PCT/EP2018/069108, Oct. 23, 2018, International Search Report and Written Opinion.
(Continued)

*Primary Examiner* — King M Chu
(74) *Attorney, Agent, or Firm* — Wolf, Greenfield & Sacks, P.C.

(57) ABSTRACT

A drinking device for the retronasal perception of an aroma substance comprises a storage container (12) for drinking liquid, at least one aroma container (20), through which air can flow, and a transporting channel (18) for drinking liquid, the transporting channel running from the storage container (12) to a mouth end (28) of the drinking device (10), and also comprises an air channel (22) for transporting aromatized air, said air channel running from at least one of the at least one aroma containers (20) to the transporting channel (18) for drinking liquid or to the mouth end (28).

19 Claims, 20 Drawing Sheets

Figure 1:
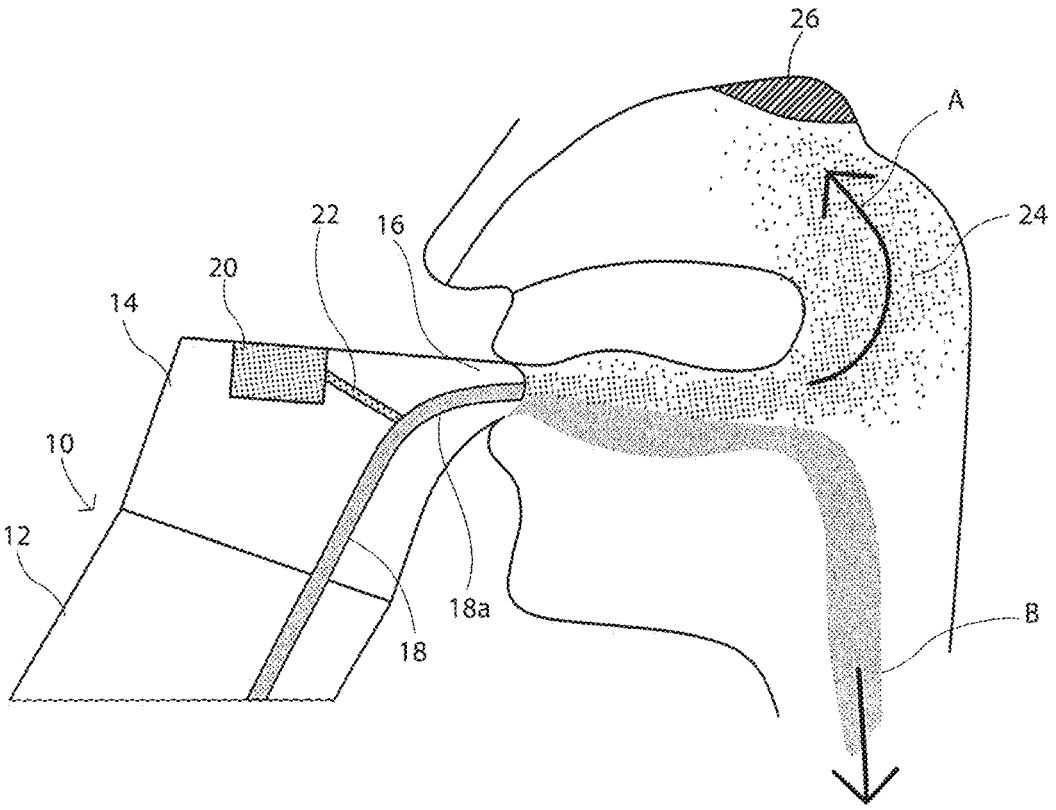

(51) Int. Cl.

| | |
|---|---|
| ***B65D 23/12*** | (2006.01) |
| ***B65D 47/06*** | (2006.01) |
| ***B65D 47/26*** | (2006.01) |
| ***B65D 47/30*** | (2006.01) |

(52) U.S. Cl.
CPC ..... *B65D 47/06* (2013.01); *B65D 47/265* (2013.01); *B65D 47/305* (2013.01); *A47G 2019/122* (2013.01)

(58) Field of Classification Search
CPC .... B65D 81/3238; B65D 23/12; B65D 47/06; B65D 47/265; A47G 19/12; A47G 19/2205; A47G 2019/122
USPC ..... 206/213.1, 219
See application file for complete search history.

(56) References Cited

U.S. PATENT DOCUMENTS

| | | | | |
|---|---|---|---|---|
| 8,662,294 | B2 | 3/2014 | Benbassat | |
| 8,662,339 | B2 | 3/2014 | Sprunger | |
| 2004/0261807 | A1 | 12/2004 | Dube et al. | |
| 2007/0062961 | A1* | 3/2007 | Rigas | A47G 19/2227 220/703 |
| 2007/0088314 | A1* | 4/2007 | Collier | A61J 1/2093 604/410 |
| 2008/0028353 | A1 | 1/2008 | Lu et al. | |
| 2008/0230079 | A1 | 9/2008 | Besso et al. | |
| 2008/0257853 | A1* | 10/2008 | Cappello | B65D 39/0029 215/261 |
| 2009/0266829 | A1* | 10/2009 | Bailey | B65D 43/0202 220/717 |
| 2011/0094904 | A1 | 4/2011 | Lee | |
| 2013/0302477 | A1* | 11/2013 | Salinas | B65D 51/28 426/115 |
| 2015/0030726 | A1 | 1/2015 | Binder et al. | |
| 2016/0046407 | A1* | 2/2016 | Robert | A47G 19/30 220/523 |
| 2020/0178712 | A1 | 6/2020 | Jäger et al. | |

FOREIGN PATENT DOCUMENTS

| | | | |
|---|---|---|---|
| CN | 101578053 | A | 11/2009 |
| CN | 106820859 | A | 6/2017 |
| DE | 20 2016 004 961 | U1 | 9/2016 |
| DE | 20 2018 000 382 | U1 | 5/2018 |
| DE | 10 2018 003 669 | A1 | 1/2019 |
| EP | 1 056 660 | A1 | 3/2005 |
| JP | 2002-037304 | A | 2/2002 |
| JP | 2004-026304 | A | 1/2004 |
| JP | 2006-520722 | A | 9/2006 |
| JP | 2012-020783 | A | 2/2012 |
| WO | WO 2019/016096 | A1 | 1/2019 |

OTHER PUBLICATIONS

International Search Report and Written Opinion for International Application No. PCT/EP2018/069108, dated Oct. 23, 2018.

International Preliminary Report on Patentability for International Application No. PCT/EP2018/069108, dated Jan. 30, 2020, with English translation thereof.

Galileo, "Wie reines Leitungswasser plötzlich Geschmack bekommt. Galileo. ProSieben" Youtube, Mar. 12, 2018 (Mar. 12, 2018), pp. 1-1, Retrieved from the Internet: https://www.youtube.com/watch?v=SiCL5J7_TMA [retrieved on Feb. 21, 2020].

Hrfernsehen. "Serie: Hessen innovativ—Joyce" YouTube, Dec. 5, 2017 (Dec. 5, 2017), pp. 1-1, Retrieved from the Internet: https://www.youtube.com/watch?v=1AfLGzcoRN8 [retrieved on Feb. 21, 2020].

* cited by examiner

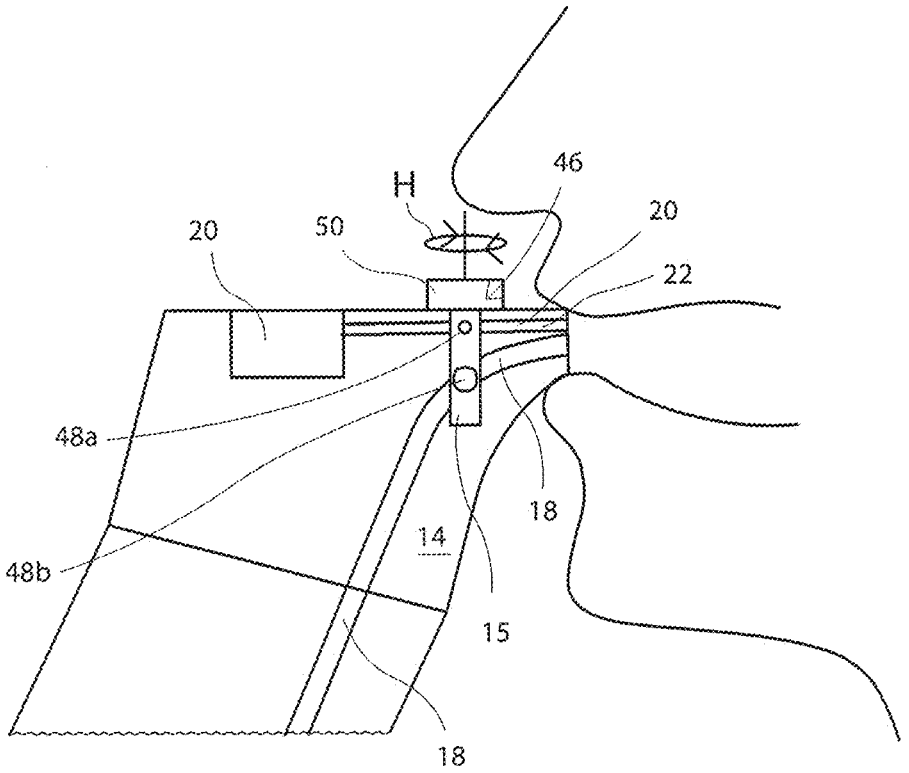
Fig. 8
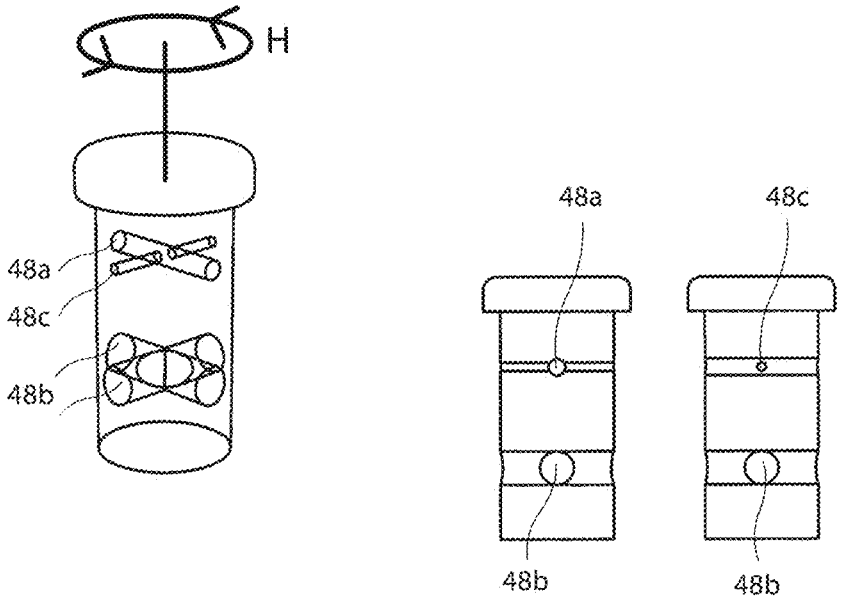

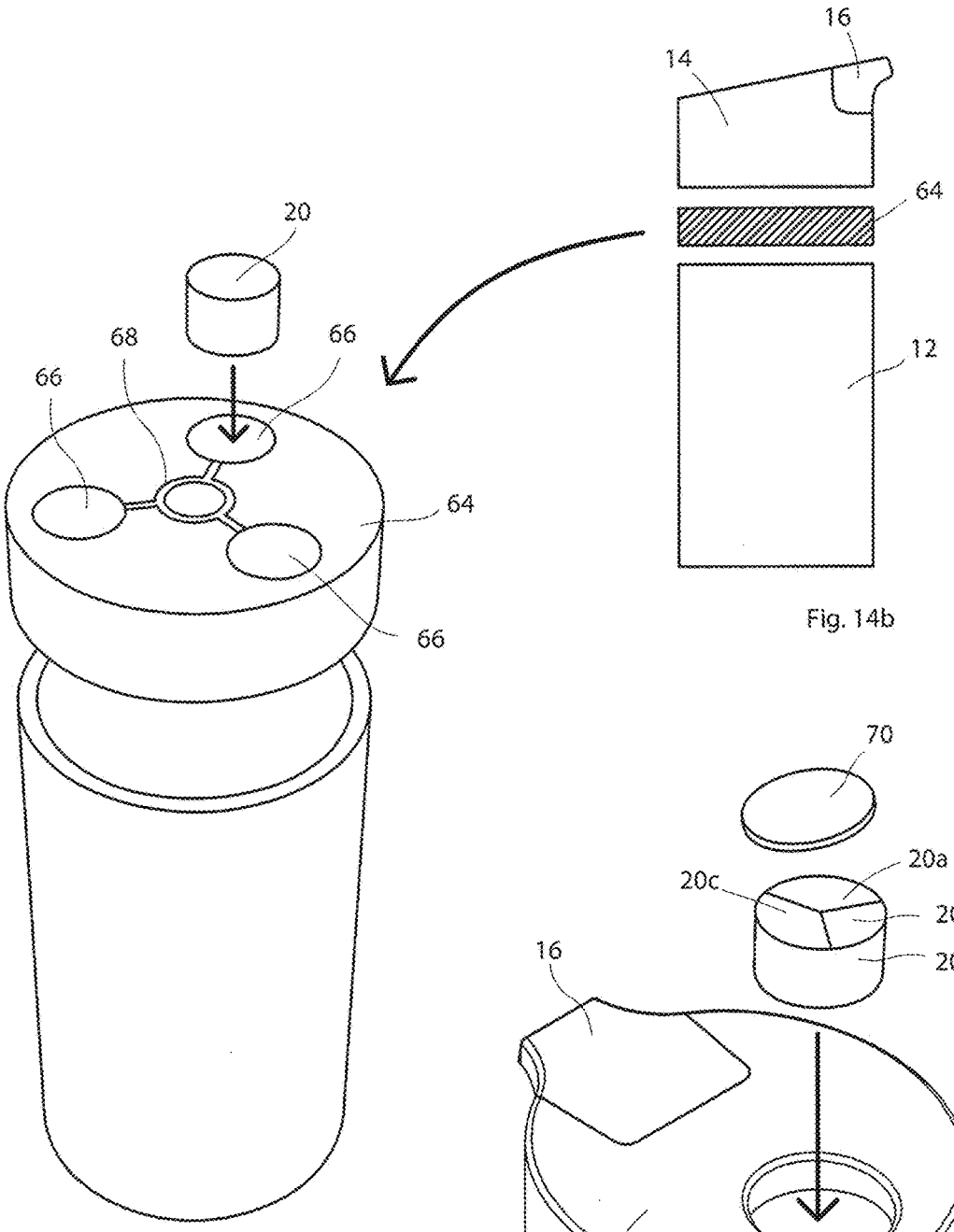
Fig. 14b
Fig. 14a
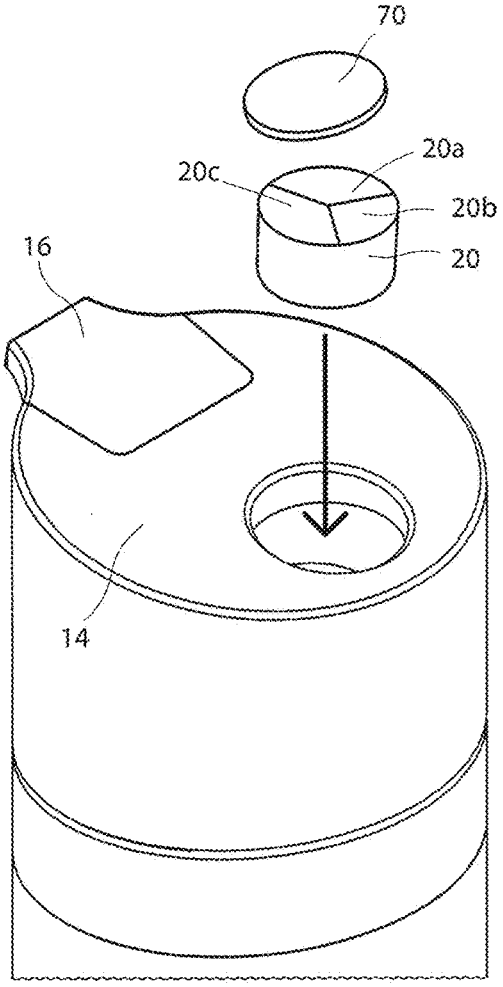
Fig. 15

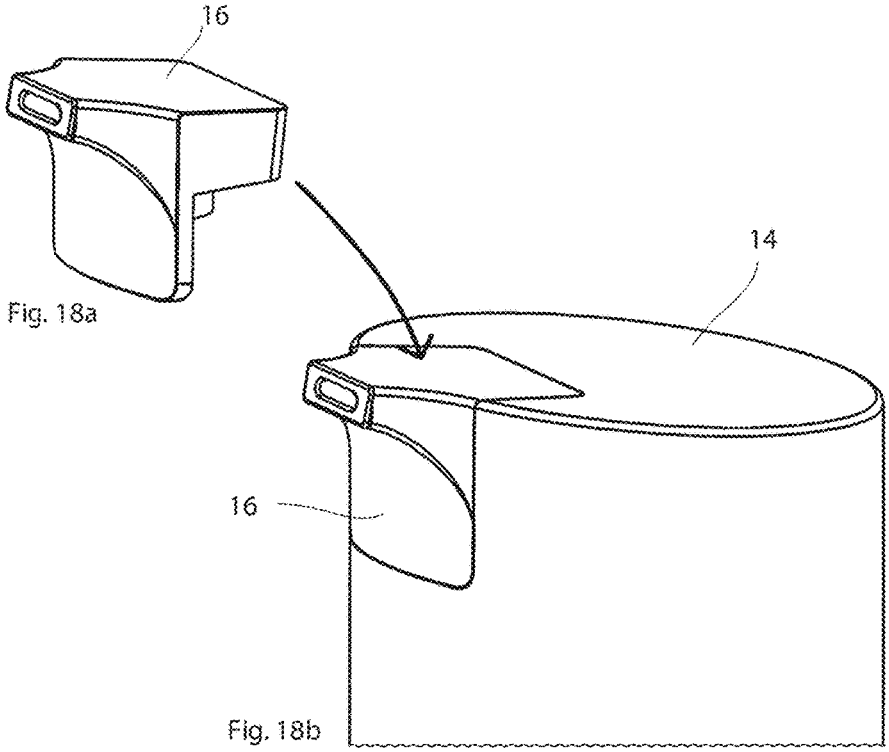
Fig. 18a
Fig. 18b
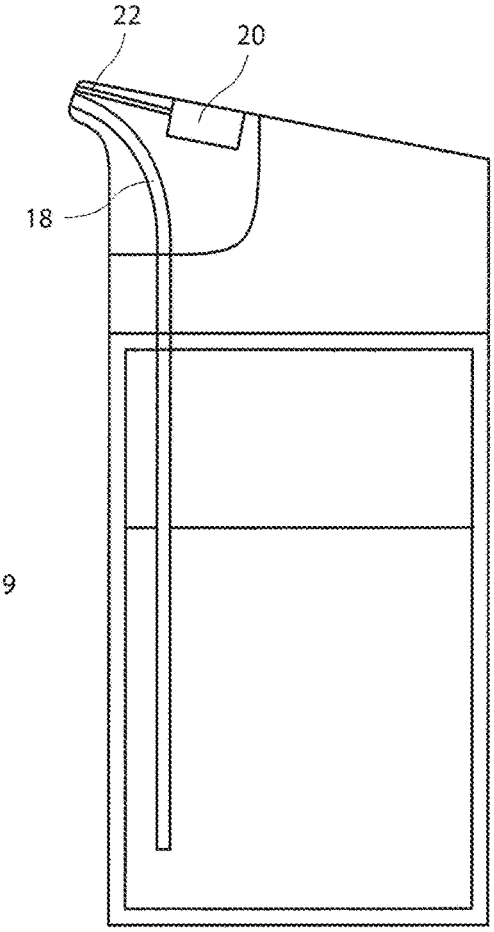
Fig. 19

DRINKING DEVICE

CROSS-REFERENCE TO RELATED APPLICATIONS

This application is a national stage filing under 35 U.S.C. § 371 of international application no. PCT/EP2018/069108, filed Jul. 13, 2018, which claims priority to German application no. 10 2018 003 669.4, filed May 5, 2018, German application no. 10 2017 009 718.6, filed Oct. 18, 2017, and German application no. 10 2017 212 472.5, filed Jul. 20, 2017, each of which is herein incorporated by reference in its entirety.

FIELD OF THE INVENTION

The invention relates to a drinking device for the retronasal perception of an aroma substance.

PRIOR ART

There is an increasing need to ingest drinking liquids which on the one hand have a pleasant taste profile but on the other prevent health risks which could be brought about by the ingestion of aroma substances or stabilizing agents dissolved in the drinking liquid. The intake of an increased quantity of calories is also to be avoided.

Water which has been given a slightly fruity aroma has therefore become popular in the last few years. However, even in this aromatized water there are undesired additives such as stabilization agents and a certain proportion of sugar, which is why these aromatized beverages likewise have a quantity of calories which is rejected by many users.

A first step towards solving this problem consists in only adding the flavouring aroma to the beverage just before it is consumed. US 2008/028353 A1, US 2015/030726 A1 and U.S. Pat. No. 86,622,904 are examples of dosing systems with which an aroma substance originally provided separately is delivered to the drinking liquid and dissolved in it immediately before or during the consumption of the beverage. Although this measure allows problems such as the stabilization of the drinking liquid to be avoided over a prolonged period of time, the problem of the undesired ingestion of additives remains.

Since the olfactory sensation plays a significant part in gustatory perception in the consumption of food and beverages, systems to date have attempted to influence the odour perceived while drinking. To that end U.S. Pat. No. 5,635,229 proposes an aroma element which can be attached close to the drink opening on a drinking container so that the aroma element is situated in the immediate proximity of the nose of the user, who breathes through the nose while drinking and thereby takes in the aroma.

The drinking vessel according to U.S. Pat. No. 8,662,339 B2 works on the principle that an aroma is inhaled through the nose while drinking.

PRESENTATION OF THE INVENTION

The object of the invention is to propose a drinking device which allows the user to have an improved taste experience.

This object is achieved by a drinking device having the feature of claim 1. Preferred embodiments follow from the other claims and the following description.

The drinking device according to the invention for the retronasal perception of an aroma substance comprises a storage container for drinking liquid, at least one aroma container through which air can flow, and a transporting channel for drinking liquid, the transporting channel running from the storage container to a mouth end of the drinking device, and also an air channel for transporting aromatized air, said air channel running from at least one of the at least one aroma containers to the transporting channel for drinking liquid or to the mouth end.

The substantial aspect of the drinking device according to the invention consists in that the aroma substance is perceived retronasally. During drinking the aroma substance reaches the mouth of the user together with the drinking liquid and subsequently rises retronasally via the pharynx to the olfactory mucosa (regio olfactoria), where it is captured by the receptors situated there and is perceived by the user. The device according to the invention is equally suited for cold or warm drinking liquids.

Advantage is taken of the fact that there is a close correlation between the sense of smell and the sense of taste. The user therefore gains the impression that they are tasting the aroma, even though they are in fact only smelling it retronasally.

A person's sense of taste is substantially determined by the retronasal sense of smell. The receptors of the tongue can only distinguish between sweet, sour, bitter, salty and umami, whereas the differentiated sense of taste arises in that the gaseous phase of foodstuffs and liquids in the pharynx ascends via the retronasal route and reaches the olfactory mucosa. The sensors located there trigger neurological irritants which cause the taste impression to arise in the brain. Thus, a person to whose pharynx an aroma is delivered during drinking gains the impression that the beverage is aromatized, since the retronasal smelling process creates in the brain a sensation that the beverage is the source of the aroma, even though the user is ingesting a pure and unadulterated, i.e. non-aromatized, liquid such as water. If the odour is perceived by breathing in through the nose, known as the orthonasal perception of an aroma substance, this impression does not arise to the same extent since the sensation is linked to the rate of breathing and thus the user gains the correct impression that he is only smelling the aroma substance, but not tasting it as is the case with retronasal perception.

The storage container, which is preferably designed to be refillable, can contain pure water or carbonated water, while the aroma substance is delivered to the air situated in the transporting channel and the drinking liquid immediately before ingestion by the user or is transported separately to the pharynx of the user.

Alternatively, however, the drinking liquid can also have an inherent taste. The existing inherent taste of the drinking liquid is either strengthened by the aroma substance from the aroma container or is supplemented by one or more additional flavour components. If the storage container contains apple juice, for instance, apple aroma can be added to strengthen the taste experience, or an orange aroma for instance can be added in order to create a blend of flavours. In this manner alcoholic beverages such as beer, for instance, can also be provided with additional aroma substances, whereby the particular prejudices of a user can be catered for by using a corresponding aroma container in the drinking device according to the invention. In addition, taste profiles which are not common in the food sector can also be used in the drinking device disclosed here, such as the "sandalwood", "spring meadow" or "unicorn" known from air fresheners. The aroma used can be synthetic or natural. It is also possible to use aromas which have been isolated or enriched from a synthetic or natural source and natural substances such as fresh or processed products, for example lemon peel, dandelion leaves, liquorice or other aromatic substances.

According to the invention, multiple aroma containers can be provided. This may entail the provision of an aroma container as a replacement which can be used as soon as the aroma container currently in use is exhausted. Alternatively or additionally, however, it is also possible to use multiple aroma containers which are used at the same time in order to be able to create any preferred blend of aromas from various basic aromas.

According to the invention, the transporting channel for drinking liquid runs to the mouth end, while the air channel either runs into the transporting channel for drinking liquid in the immediate vicinity of the mouth end or runs to the mouth end separated from the transporting channel for drinking liquid.

The advantage of the solution whereby the air channel runs into the transporting channel for drinking liquid in the immediate vicinity of the mouth end consists in that no misuse is possible. When the drinking liquid is ingested, the aroma substance is automatically perceived as well. However, the disadvantage of this solution is that there are air bubbles in the drinking liquid. Drinking is consequentially associated with a heightened noise development comparable to drinking from a straw through which both liquid and air are sucked in. Furthermore, the user no longer has the desired impression of drinking a pure liquid such as water. Finally, a further disadvantage exists in that the contact between the drinking liquid and the aromatized air exists over a longer period of time, during which a mass transfer of the aroma substance from the air into the surrounding drinking liquid takes place. The drinking liquid is therefore "contaminated" in the perception of the user, regardless of the innocuousness of the aroma substance. Therefore, those solutions in which the air channel runs to the mouth end separated from the transporting channel for drinking liquid are preferred.

According to a preferred embodiment of the invention, the mouth end is designed such that the transporting channel for drinking liquid and the air channel for transporting aromatized air run separated from one another at the mouth end and substantially the same distance in the longitudinal direction. "Longitudinal direction" is to be understood to mean the direction in the longitudinal extension of the transporting channel for drinking liquid and of the air channel for transporting aromatized air at the mouth end. In other words, during drinking the transporting channel for drinking liquid and the air channel run substantially the same distance into the oral cavity of the user.

With this technical solution, the aromatized air and the drinking liquid are sucked in separated from one another. The aromatized air need not only escape from the surrounding drinking liquid in the form of air bubbles, but can rise retronasally via the pharynx to the olfactory mucosa after entering the oral cavity. A further advantage of having the aromatized air and the drinking liquid delivered separately into the oral cavity consists in that an even lower mass transfer between the air and the drinking liquid can take place. There are two reasons for this. The first is that the aromatized air is not contained in the drinking liquid in the form of small bubbles, and so a much smaller total surface area is available for the mass transfer between the liquid phase and the gaseous phase. The second reason is that the user swallows a much smaller and actually negligible quantity of aromatized air together with the drinking liquid, since the aromatized air is already present as a separate phase and no prior separation is thus required. Finally, this technical solution also has the advantage that the user has the feeling they are ingesting a clear drinking liquid, not a liquid that is aerated with gas, albeit only to a small extent. The user perceives that they are consuming a pure liquid such as water.

A variant of the solution according to the invention consists in that the mouth end is designed such that, when the drinking device is used, the transporting channel for drinking liquid and the air channel for transporting aromatized air extend different distances into the oral cavity of the user. Two different possibilities are of course conceivable here. Firstly, the air channel for transporting aromatized air can extend further into the oral cavity of the user than the transporting channel for drinking liquid. Alternatively, the transporting channel for drinking liquid can extend further into the oral cavity of the user. It is common to both solutions that the aromatized air and the drinking liquid are sucked out of the device separated from one another. Both variants also have in common that the mass transfer between the aromatized air and the drinking liquid is kept as low as possible. This advantage can, though, be achieved in identical fashion if the transporting channel for drinking liquid and the air channel for transporting aromatized air extend equally far into the oral cavity of the user, but both are designed such that they project into the oral cavity of the user when used as intended. However, the user will perceive an extension too far into the oral cavity as unpleasant.

The technical challenge of all solutions described above consists in coordinating the geometries of the transporting channel for drinking liquid and of the air channel to each other such that, depending on the drinking position and in the case of special drinking liquids and also depending on the viscosity of the drinking liquid, the aromatized air and the drinking liquid are sucked in in the desired proportion to one another.

According to a preferred embodiment of the invention, the drinking device also comprises a throttle device and/or sealing device for the transporting channel for drinking liquid and/or the air channel for transporting aromatized air, whereby the sealing device is preferably provided in a mouthpiece surrounding the mouth end and the mouthpiece can be moved from a sealing position into a non-sealing position.

A throttle device can be provided as an alternative to a sealing device, but preferably supplements a sealing device. A throttle device enables the ratio of drinking liquid to aromatized air to be adjusted, so that for example the degree of aromatization or the flow rate of the drinking liquid can be adjusted. A simple embodiment of a throttle device, but which can be operated up to complete sealing, is a squeeze device by means of which a flexible portion of the transporting channel or air channel can be reduced with respect to its internal cross-section or pinched off entirely.

A preferred alternative embodiment of the sealing device is the provision of a pull valve which is preferably situated on the mouthpiece and is pulled out by the user in order to open the flow. After drinking, the pull valve is pressed back into the mouthpiece in order to close the air channel and the transporting channel.

A further preferred alternative of the drinking device according to the invention comprises a rotary valve which the user opens or closes by turning. The use of rotary valves is well known from chemical engineering, since a rotary valve constitutes a simple but very tight-sealing component. Furthermore, a rotary valve can also be adjusted infinitely, so that a rotary valve combines the functionalities of a throttle device and a shut-off device in one.

A further preferred alternative of the device according to the invention comprises a slide valve, which according to a preferred variant is provided in a lid of the drinking device and can simultaneously contain the mouthpiece. The advantage of such a slide valve consists in that it is immediately obvious whether the valve is in the open or the closed state.

A preferred alternative embodiment of the device is the provision of a rotating lid which is either placed or screwed on and thereby seals the drinking device. A rotating lid is well suited to sealing the drinking device tightly even when an increased pressure is building up in the interior of the storage container, as can occur if the drinking liquid is a carbonated beverage. Such a lid can tightly seal both the transporting channel for drinking liquid and the air channel for aromatized air, but in the same manner also another air line for delivering air into the interior of the storage container for the purposes of equalizing the pressure. A further advantage of the rotating lid is that it protects the mouthpiece from contamination and is thus an element that is familiar to every user, and the suitability of which for tightly sealing the drinking device is relied upon.

A preferred alternative embodiment of the device is the provision of a sports valve, such as is known with drinking bottles carried when cycling, for instance. The function of a sports valve is accordingly known, so that the user intuitively pulls the valve to drink and presses it back into its original position after drinking.

However, the embodiment whereby the mouthpiece of the drinking device is simultaneously a shut-off device by means of which all transport routes running in the direction of the mouthpiece can be tightly sealed is particularly preferred. In this case the mouthpiece according to a preferred variant of the invention is designed such that it can be moved from the sealing position to the non-sealing position by means of a translational motion. The mouthpiece can then be designed such that both the transporting channel for drinking liquid and the air channel, but also the air line for delivering air into the interior of the storage container, can be sealed and opened. Consequently, the user just has to bring the mouthpiece into an operating position, causing the sealing device to be actuated without the user noticing. In this manner the number of construction elements can be kept low, thereby enabling a more hygienic design and also a cost saving in the production and assembly of the drinking system, among other benefits.

According to a preferred embodiment of the invention, the at least one aroma container can be removed and inserted in the drinking device according to the invention by means of a simple motion sequence. According to a preferred variant, a bayonet closure can be used for this purpose. A bayonet closure has the advantage that, after insertion, the correct orientation of the aroma container in the drinking container is ensured. According to a further preferred variant, a spring element can also be provided, said spring element allowing the aroma container to be withdrawn from its receptacle as soon as the aroma container was not inserted properly. Different engagement positions also allow selection between different settings of aroma intensity.

Preferably one of the at least one aroma containers has a sealing device, whereby the aroma container can be moved from a sealing position into a non-sealing position. An aroma container with a substantially round cross-section can be used in identical manner to the rotary plug described above, in that the aroma container is rotated around its axis of symmetry in order to bring the transporting channel for drinking liquid into flush alignment with the channel through the aroma container. The advantage of this solution consists in that no additional component is required.

Alternatively, however, it is possible in the same manner to move the aroma container from a sealing position into a non-sealing position by moving the aroma container in an axial direction. Thus, for instance, an aroma container with any desired prismatic or annular geometry could be pressed in an axial direction in order to bring the aroma container into a non-sealing position. The aroma container can engage in this position, i.e. remain in this position automatically, or drinking with the delivery of an aroma is only possible if the aroma container is kept depressed. In this manner a user could additionally choose between drinking liquid with and without aromatized air.

According to a preferred embodiment of the invention, at least one of the at least one aroma containers can comprise multiple chambers which contain aroma substances of different odour intensities and/or different odour qualities. According to a further alternative of the drinking device according to the invention, multiple aroma containers can be provided. In other words, one or more aroma containers can be provided and this aroma container or any number of the multiple aroma containers can additionally comprise multiple chambers. In this manner any desired variants can be realised. If a single aroma container is provided, it can contain different aromas, so that a different aroma is delivered depending on the direction of insertion or even an orientation of the aroma container which the user can change while drinking. Furthermore, if a single aroma container is provided both the type of aroma and the strength of the aroma can be varied. Thus, an aroma container could contain two, three or more different aroma intensities of one and the same aroma substance, or a single aroma container could even contain two different aromas but which are each provided in two different stages, so that the aroma container would comprise four separate chambers.

If multiple aroma containers are provided, a user can create any individually desired aroma blends through the variation of different aroma profiles and aroma strengths or even the addition of one and the same aroma profile.

According to a preferred embodiment of the invention, one of the at least one aroma containers is situated in a mouthpiece of the drinking device, whereby the mouthpiece is preferably replaceable. This solution has the advantage that the hygiene of the drinking device is improved, since the mouthpiece is replaced with the aroma container and hence a new mouthpiece is attached to the drinking device after the aroma container has been exhausted. Nevertheless, with this solution it must be ensured that the mouthpiece closes tightly with the storage container for drinking liquid.

The provision of the aroma container either integrated into the mouthpiece or on a lid of the storage container has the advantage that the user can identify the "taste profile" directly. Thus, for instance, the mouthpiece could be coloured according to the chosen aroma and, for instance, have a yellow colour for a lemon aroma or a green colour for a green apple aroma.

According to a preferred embodiment of the invention, the storage container for drinking liquid is provided with a lid. If the lid is removed, the user can access both a filler opening for drinking liquid and a receptacle opening for an aroma container or multiple aroma containers. After the lid is fitted, it is then possible to vary between different aroma profiles by rotating the lid. The advantage of this solution consists in that no separate means for locking the aroma container is required in the drinking device according to the invention, because the aroma container is automatically fixed in the inserted condition after the lid is fitted. This solution also makes it easier to seal the aroma container.

According to a preferred variant, on the aroma container is provided an information tag which protrudes outwards out of the drinking device after the lid is fitted and informs a user about the aroma profile inserted. The tag can be comfortably grasped in order to remove the aroma container.

According to an alternative preferred embodiment of the invention, the aroma container is designed as a ring which is situated close to the mouth end of the drinking device. There can be a single chamber in the ring. In the annular aroma container may be provided multiple chambers with different taste profiles which are preferably identified for the user by an additional marking and/or colouring. In this manner the user can intuitively change the aroma by operating the aroma ring, which can also be done while drinking. The use of an aroma container in the form of a ring thus offers many options which can be used in a user-friendly manner.

According to a preferred embodiment of the invention, the drinking device according to the invention also comprises a valve as pressure equalization valve which closes an air supply line leading into the interior of the storage container for drinking liquid. If an underpressure builds up in the storage container due to the drinking, i.e. removal, of drinking liquid, the valve opens and allows air to enter the storage container for drinking liquid. As soon as the pressure has been equalized, the pressure valve closes again automatically due to its residual stress, so that no drinking liquid can escape. This variant is particularly advantageous in those cases in which the shut-off device only closes the transporting channel for drinking liquid and the air channel for transporting aromatized air, but not the air channel for pressure equalization. An example of such a variant is the provision of a mouthpiece which can be swivelled from a sealing position into an operating position while the air line for pressure equalization is situated elsewhere on the container.

According to a further preferred embodiment of the invention, the drinking device also comprises a head part which comprises the mouth end and is moveably arranged relative to the storage container, whereby the head part can be moved from a position sealing the transporting channel for drinking liquid and/or the air channel into a non-sealing position.

In the simplest case the head part of the drinking device can be rotatably attached to the storage container for drinking liquid. The geometry of the head part relative to the storage container can be chosen such that, as the head part is being brought into the drinking position by rotation, it is angled so that a drinking posture that is ergonomically comfortable for the user is possible and, secondly, it is also clear for the user that the drinking device is in an operationally ready state and the drinking liquid can run out if the device is not handled properly. In this manner a drinking device with a futuristic-looking form that underscores the claim to a new and innovative drinking device can be designed.

The drinking device according to the invention can be designed in a wide variety of ways. It can be a mobile drinking bottle which is executed as a Thermos flask with either one or two walls. In the same manner, however, an open drinking vessel comparable to a beaker can also be provided, although attention must be paid to the correct drinking posture so that both the drinking liquid and the aroma to be dosed are led into the pharynx while drinking. With this technical solution, the aroma container could be a ring which surrounds the storage container for drinking liquid and from which the aroma is either dosed to the transporting channel for drinking liquid or is delivered to the user in an air channel running separately on the container edge of the drinking beaker.

Alternatively, however, the drinking beaker can be closed at the top and used as a shot glass. This variant can be used in order to modify the taste of drinking liquids such as spirits, liquors or even caffeinated or decaffeinated beverages with certain aroma substances, or to strengthen an existing taste or hide possibly undesired sensations.

A further alternative design consists in integrating the functional particularities of the drinking device according to the invention in a straw which contains the mouth end and whose end opposite the mouth end is situated in the storage container for drinking liquid. In this case the straw is simultaneously the transporting channel for the drinking liquid running from the storage container to the mouth end of the drinking device. The aroma container can be provided in the form of a ring surrounding the straw and be situated above the level for drinking liquid, so that when the straw is used air is sucked into the aroma container and is either led to the mouth end via an air channel running parallel to the transporting channel for drinking liquid or runs into the transporting channel for drinking liquid, so that the delivered aroma is dosed to the drinking liquid in the form of air bubbles.

Common to all the above ideas and variants is that the aroma substance is led into the mouth and pharynx of the user via the mouth end and the taste impression arises from the retronasal perception of the aroma substance. Apart from a to a small extent unavoidable absorption of the aroma substance in the pure drinking liquid, or an incomplete separation of air bubbles carrying aroma substance from the drinking liquid, the user perceives a pure drinking liquid.

A preferred embodiment of the invention for optimising or simplifying the drinking device provides for the head part of the drinking device to be separable, detachable or hinged. The head part then consists of one, two or more parts which must be assembled in order to use the device. In that case a separation of the head part substantially along the axis of symmetry, for instance, is possible, so that in the non-assembled position the channels of the drinking device are fully or partially open. This offers a number of advantages. Firstly, it makes it easier to clean the drinking device, since the partially narrow channels of the devices can be easily reached by cleaning liquid and the cleaning liquid is not held back by any capillary forces that might occur. In addition, a separable solution of the head part of the drinking device makes it possible to integrate the aroma container of the drinking device into the interior of the head part. In existing systems the aroma container can only be attached externally, so that it remains visible during use. Existing systems also require a separate attachment mechanism for the aroma container, which a separable solution does not.

The head part is to be understood as that part of the drinking device in which the substantial technology and/or the aroma container of the drinking device is/are arranged. Expediently it is attached to the head of the drinking device, but can also be situated at any other place of the drinking device or be integrated into the drinking device.

The use of a substantially elastic material such as silicone or other elastomers for the manufacture of the separable or non-separable head part or parts of the head part of the drinking device can, for instance, make it easier to seal the system. In addition, separability of the head part allows a greater number of possibilities for connecting the head part with the storage container for liquid of the drinking device.

A further preferred embodiment of the invention consists in that the channels have a special form. It is, for instance, possible for the channel for the liquid to be widened or narrowed at one, two or more places, so that the diameter of the channels is greater or smaller there than at the other places. A narrowing or widening can, for instance, be configured in or at the mouthpiece of the drinking device. This enables a different sensation on the mouth of the user when drinking from the drinking device. In existing solutions the drinking sensation constitutes a problem since the consumer is not used to drinking liquid together with air bubbles. The widening or narrowing of the liquid-bearing channel at one or more places allows the pressure conditions there to be modified, so that the size and/or form of the air bubbles contained in the liquid changes. This improves the user's drinking sensation.

A further preferred embodiment of the invention is a modification of the geometry of the liquid channel at the point where the air channel enters the drinking device. This can exhibit a number of advantages. For instance, a narrowing of the liquid channel at the point of entry of the air channel can allow the venturi effect to be exploited. The narrowing at the point of entry means that the dynamic pressure (impact pressure) there is at its maximum and the static pressure at its minimum. The velocity of the liquid rises in proportion to the cross-sections as it flows through the constricted part, since the volume of liquid does not change. At the same time, the pressure in the air channel, which is preferably attached at the narrowest point, falls. This creates a pressure difference which increases the absorption of the aromatized air into the liquid of the drinking device. Thus, for instance, the user needs to suck less strongly on the drinking device, so that the drinking sensation is improved or design benefits arise.

A further preferred modification of the geometry of the channels in the drinking device comprises different surfaces on the inside of the channel or obstacles which change the flow conditions in the liquid-bearing channels. Cavitation can occur, for instance. Cavitation or a mechanical comminution of the air bubbles allows a modified air bubble size and/or air bubble geometry to be achieved. This, too, improves the sensation experienced by the user when drinking. The change in the air bubble size can, for instance, be achieved by using a substantially sieve-like geometry or a membrane.

The air channel of the drinking device can likewise exhibit a special form. Existing solutions use a consistently uniformly shaped channel. The air channel must then have small diameters, which means that problems occur when producing the head part for the drinking device. Furthermore, a narrow channel makes it more difficult to clean the drinking device. The solution according to the invention therefore provides for the air channel to be narrowed essentially for only a short distance. This both simplifies production and makes cleaning easier.

A further preferred embodiment of the drinking device according to the invention provides for the aroma unit of the drinking device according to the invention to have to be activated before use. The aroma can initially be encapsulated microscopically or macroscopically. Activation can, for instance, occur through a change in temperature or a mechanical process. A preferred embodiment provides for an air-permeable filter in which is positioned a substantially round aroma unit, the interior of which substantially contains a fluid which comprises an aromatizing substance. The shell of the aroma unit preferably consists of a material such as gelatine or agarose, so that in the inactive state a tight shell holds the fluid with the aromatized substance in a non-volatile state. The fluid is released into the surrounding filter by the activation, such as the destruction of the shell under pressure. Such solutions are proposed for use in cigarettes, for instance in US 20040261807 A1. According to the invention, in a preferred embodiment this technology is to be used in the drinking device according to the invention. This gives a number of advantages. For instance, it allows the aroma substances to be protected from oxidative processes, and generally packaging material can be saved and plastic seals avoided.

A further preferred embodiment of the drinking device according to the invention provides for the air channel to comprise a specially shaped chamber. This solves the problem that the fluctuations in the pressure and flow conditions in the transporting channel for drinking liquid that occur at the end of the process of drinking from the drinking device lead to drinking fluid getting into the air channel and/or the aroma container. This ingress of liquid into the aroma container can, for instance, lead to unwanted dilution of the fragrance-emitting substance or the occurrence of hygiene problems. The interruption of the air channel by a chamber can be executed in that a recess is provided in the head part of the drinking device at the place where the detachable transporting channel for drinking liquid and the air channel come into contact. In a preferred embodiment, the air channel coming from the aroma container runs into the chamber in a position substantially at the top. On the substantially opposite side, the air channel is continued at a position of the chamber which is substantially at the bottom. The chamber prevents the drinking liquid from flowing back into the aroma container. The substantially opposite position of the continuation of the air channel allows ideal use of the chamber. The different height positions of the inlet and outlet opening of the air channel into and out of the chamber enable, among other things, the drainage of drinking liquid back into the drinking device. The possible arrangement of the chamber at the point of contact between the head part and the transporting channel for drinking liquid makes it easier to clean the two components after they have been separated.

Common to all preferred embodiments and combinations of technical features set out above and below is that a mediated air flow through the air channel during normal drinking from the drinking device according to the invention expediently lies between about 250 and 550 ml/min. In the case of an air channel, for instance, this air flow is achieved with a diameter of between about 0.5 to 2.5 mm, or in the case of a non-circular cross-section with a cross-section area of the air channel of between 0.2 mm2 and 4.9 mm2. The air flow can also be adjusted in another manner, such as by means of a substantially short narrowing of the air channel, by means of a valve which can also be configured as a check valve in order to prevent the ingress of liquid into the air channel and/or the aroma container, or by means of a membrane. A substantially permeable membrane can, for instance, be attached at the point where the air channel enters the transporting channel for drinking liquid. Not only is the air flow thereby adjusted to a useful degree, but the air bubbles that get into the liquid flow are also adjusted to a desired size, which gives the drinker a more pleasant sensation when drinking. A further advantage of the use of a membrane at this point is also that the fluctuations described above in the pressure and flow conditions when the drinking process ends do not lead to drinking liquid entering the air channel and/or the aroma container or its volume being reduced at this or any other moment.

A further problem of the drinking device according to the invention consists in sealing the entire drinking device for transport. It should be noted that it is not only the drinking opening and the pressure equalization channel that need to be sealed, but also the air channel of the drinking device, in order to prevent the ingress of drinking liquid into the aroma container. It would be desirable if the user of the drinking devices were to be able to close all three openings in just one operation. A further preferred embodiment therefore provides that the drinking device is sealed with a lid which closes all three openings simultaneously. This can preferably be made possible in that a pin is inserted into each of at least one of the three openings and any remaining openings are sealed through conventional systems. For instance, a pin can be inserted far enough into the transporting channel for drinking liquid for the point at which the air channel enters the transporting channel for drinking liquid to also be sealed, so that an ingress of drinking liquid into the air channel and/or the aroma container is prevented. A further preferred embodiment, which solves the problem described at the beginning of this section of sealing the aroma container, provides for the aroma container to be, for instance, substantially configured in annular form and for the fluid connection between the aroma container, which can for instance be removed, and the air channel to be interrupted by a movement such as the rotation of the aroma container. To achieve this, the air outlet opening on the aroma container must, for instance, be arranged eccentrically, so that an aroma container fitted the wrong way round closes the aroma container-side end of the air channel.

Figure 2:
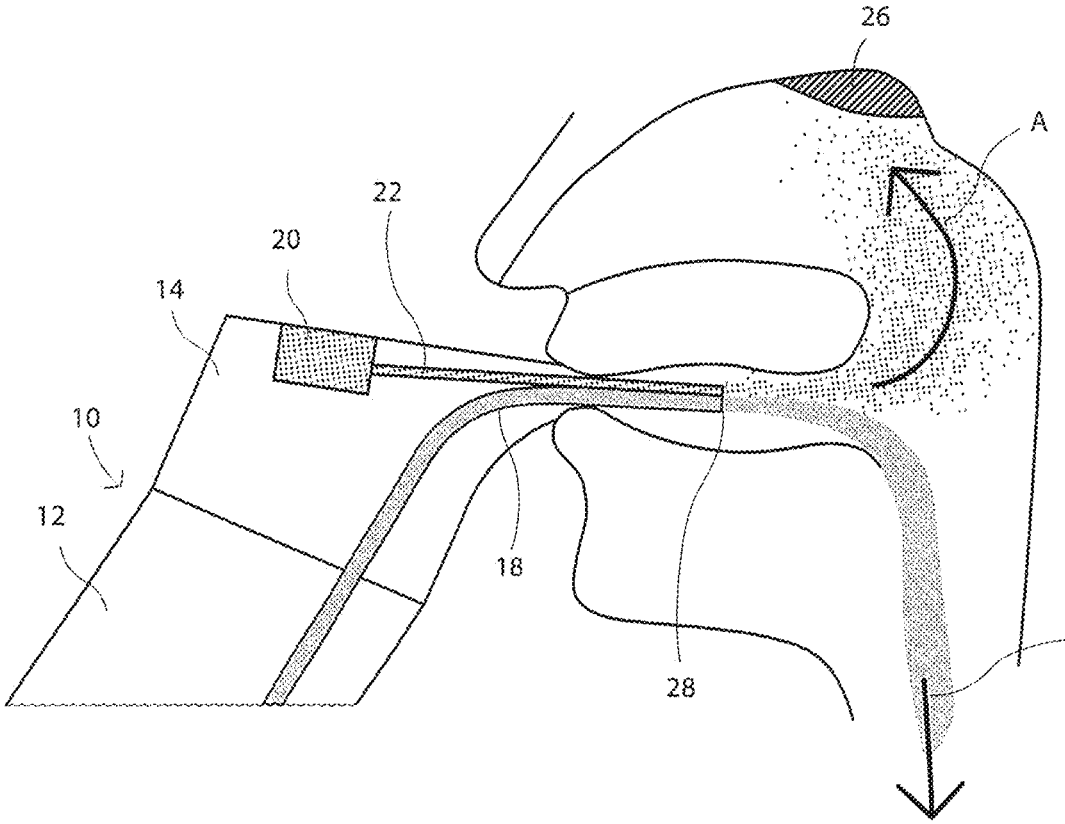
Figure 3A:
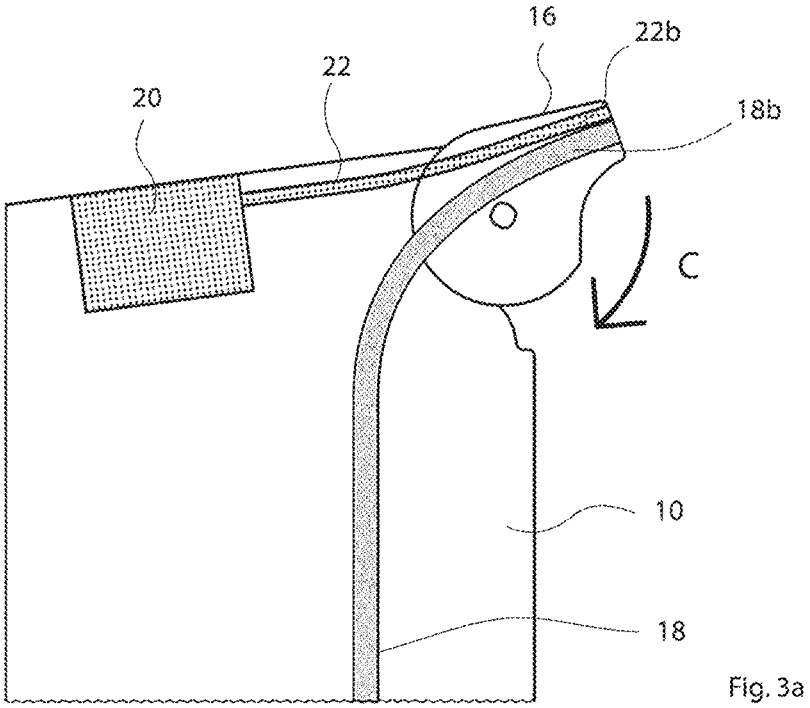
Figure 3B:
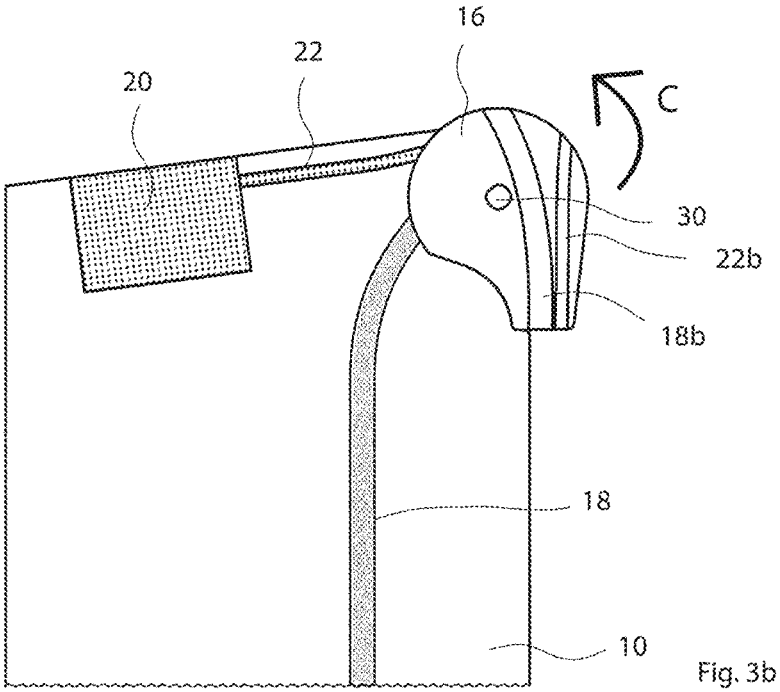
Figure 4A:
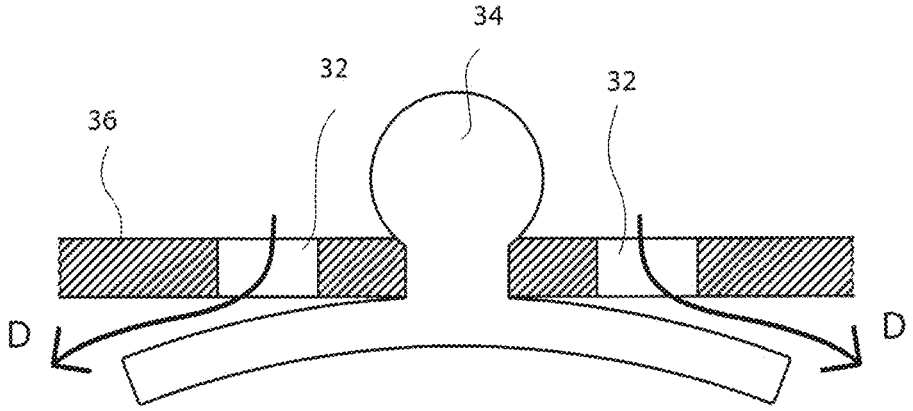
Figure 4B:
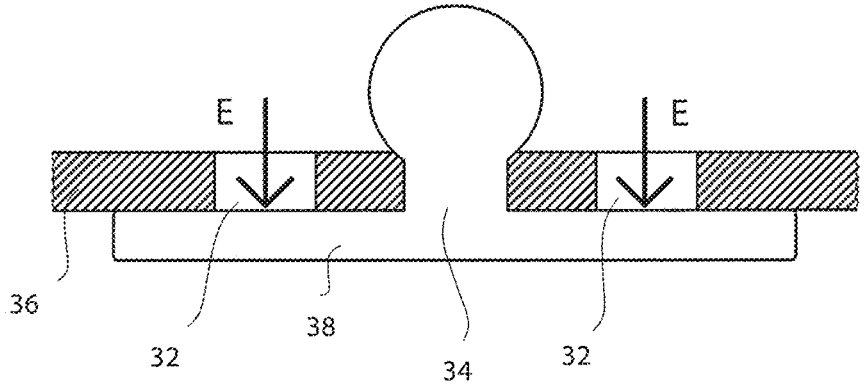
Figure 5:
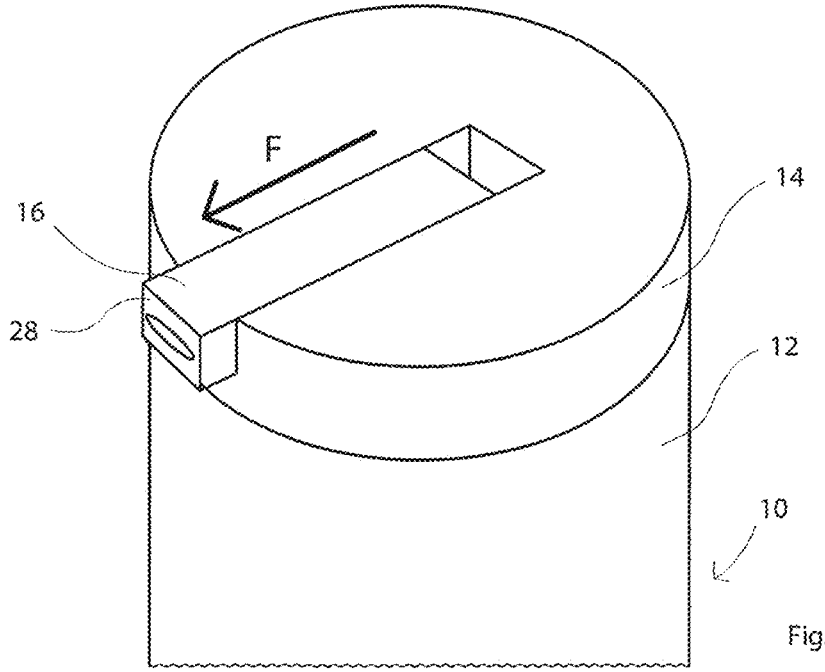
Figure 6:
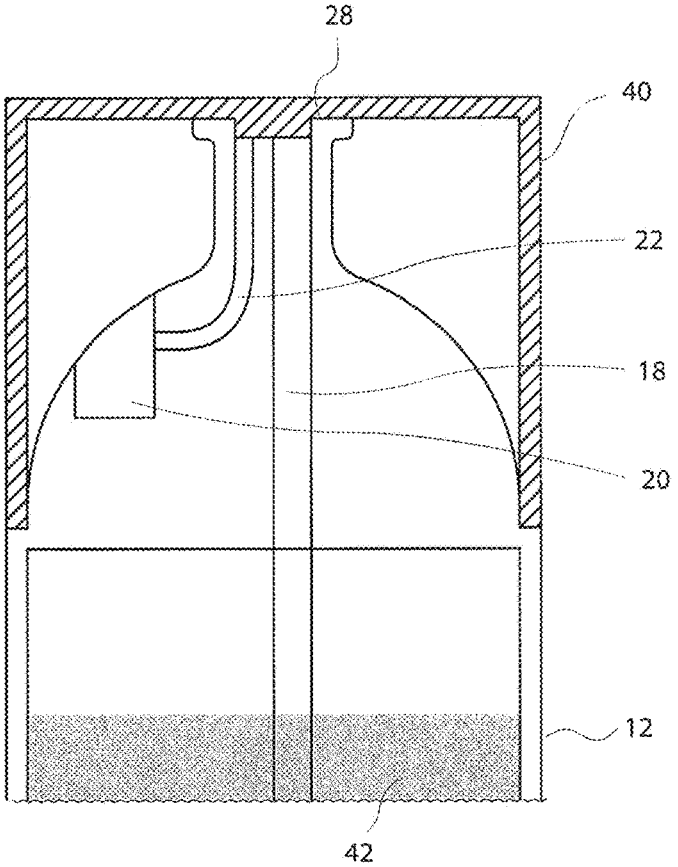
Figure 7:
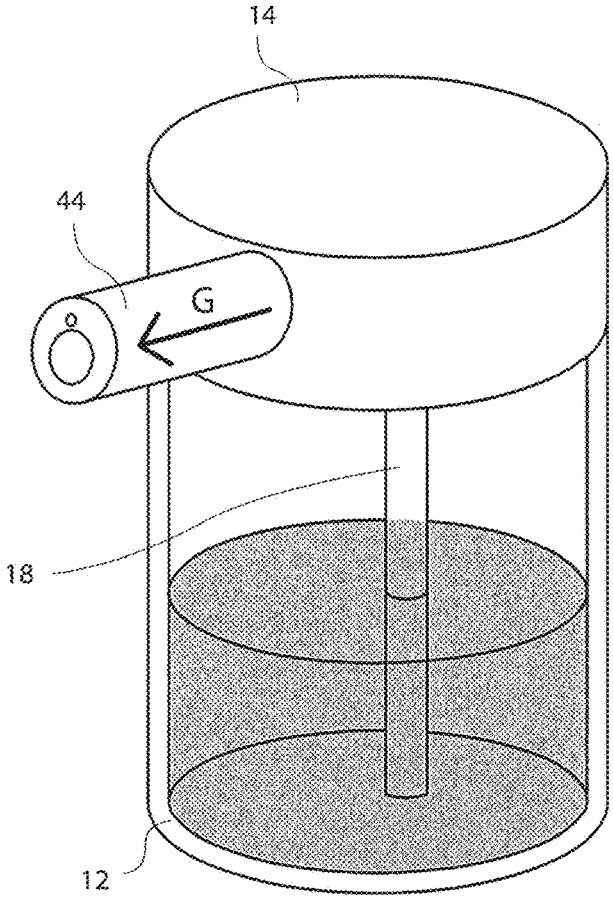
Figure 9:
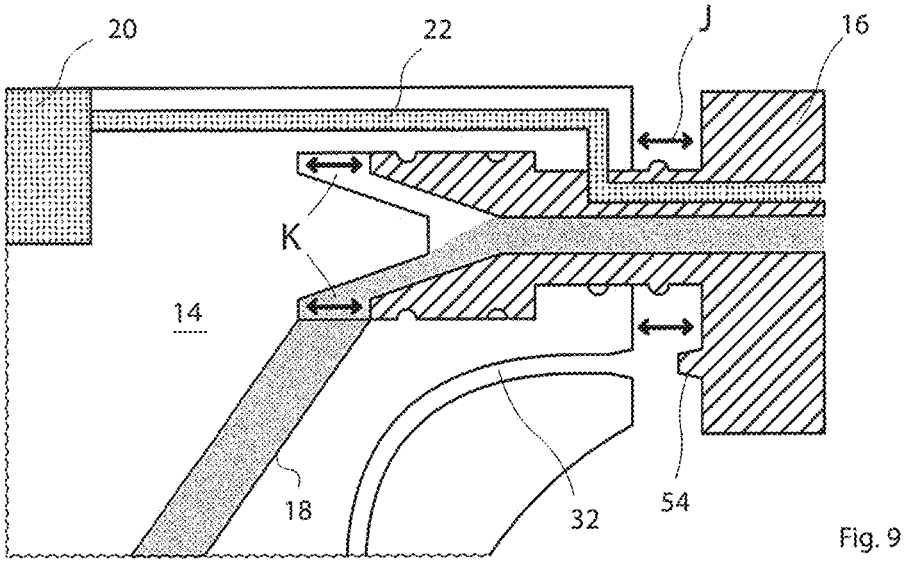
Figure 10:
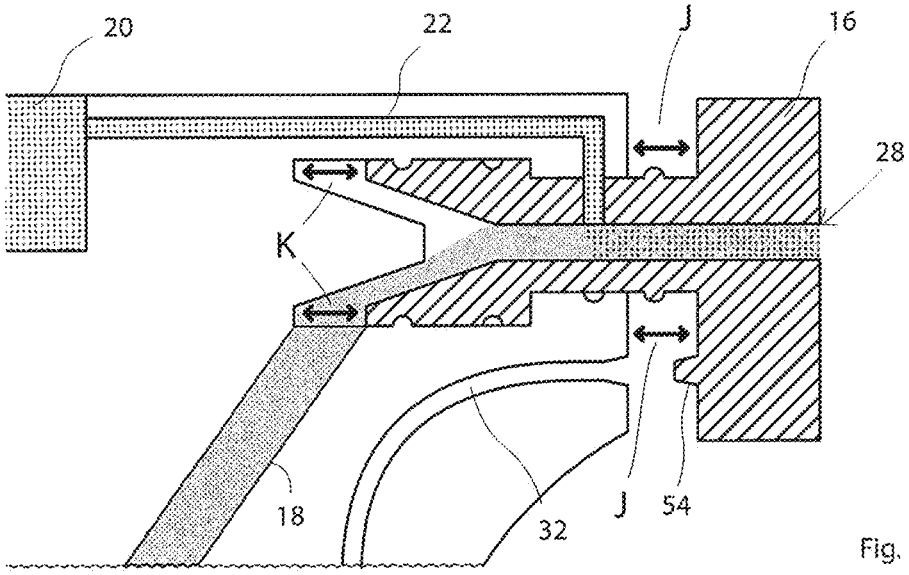
Figure 11A:
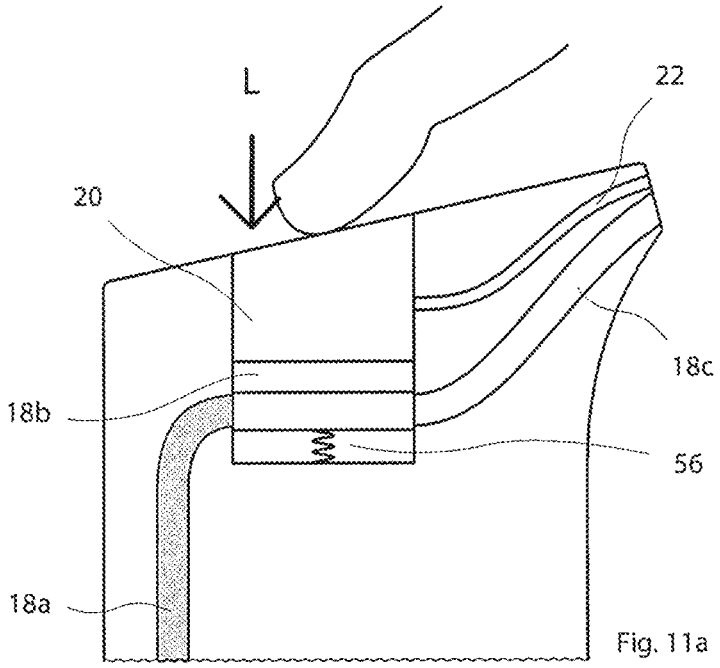
Figure 11B:
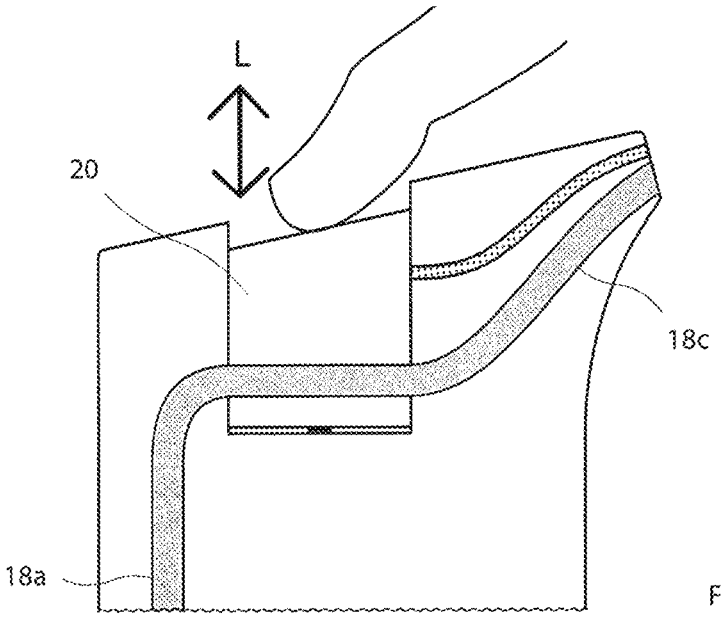
Figure 12A:
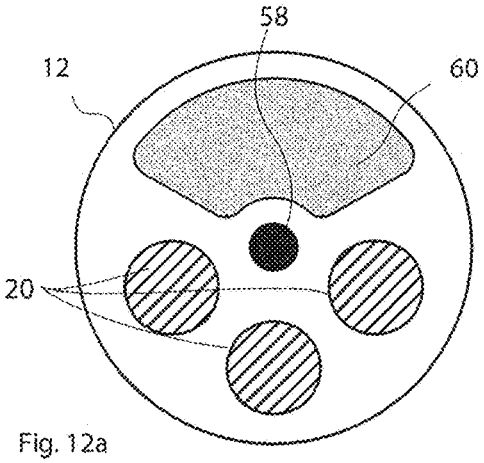
Figure 12B:
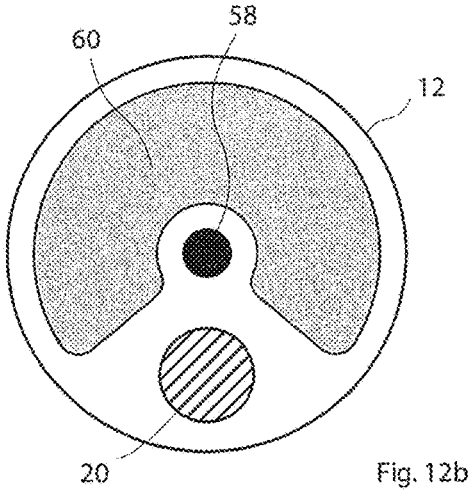
Figure 12C:
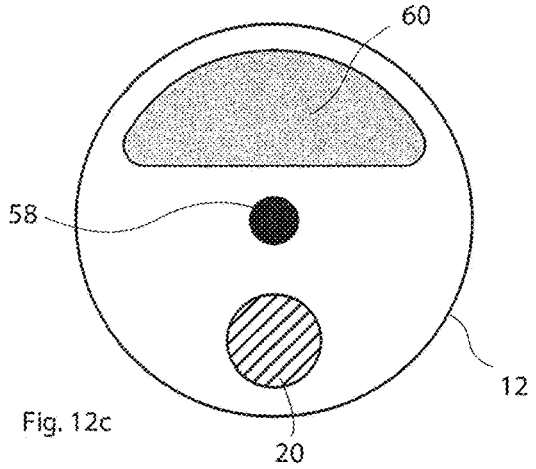
Figure 12D:
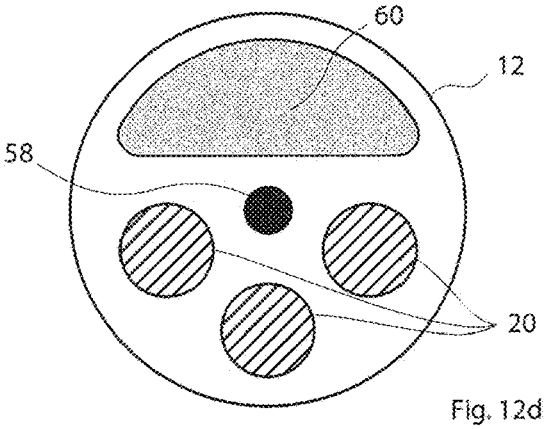
Figure 13:
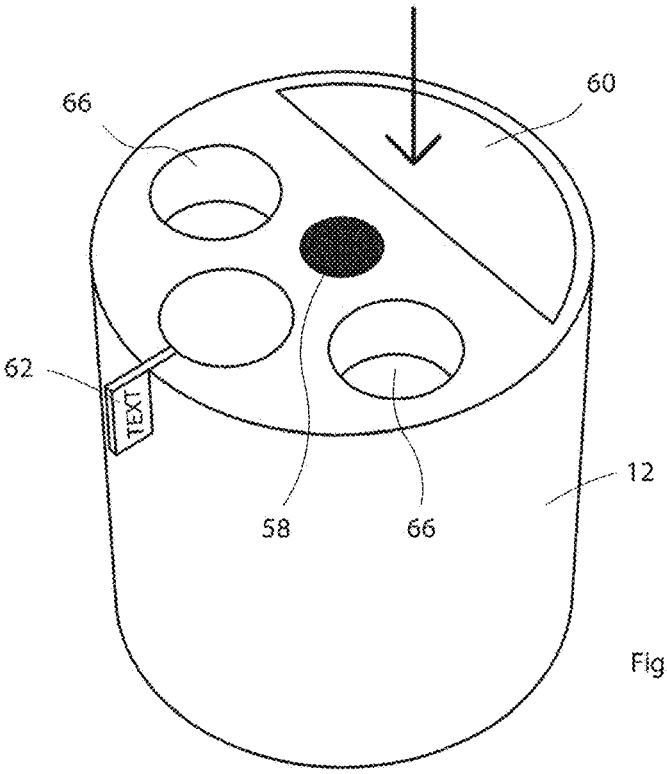
Figure 16:
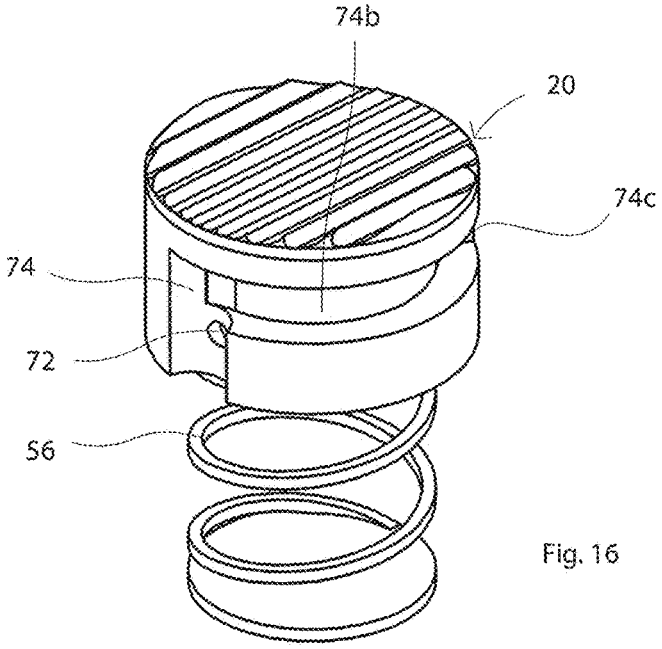
Figure 17:
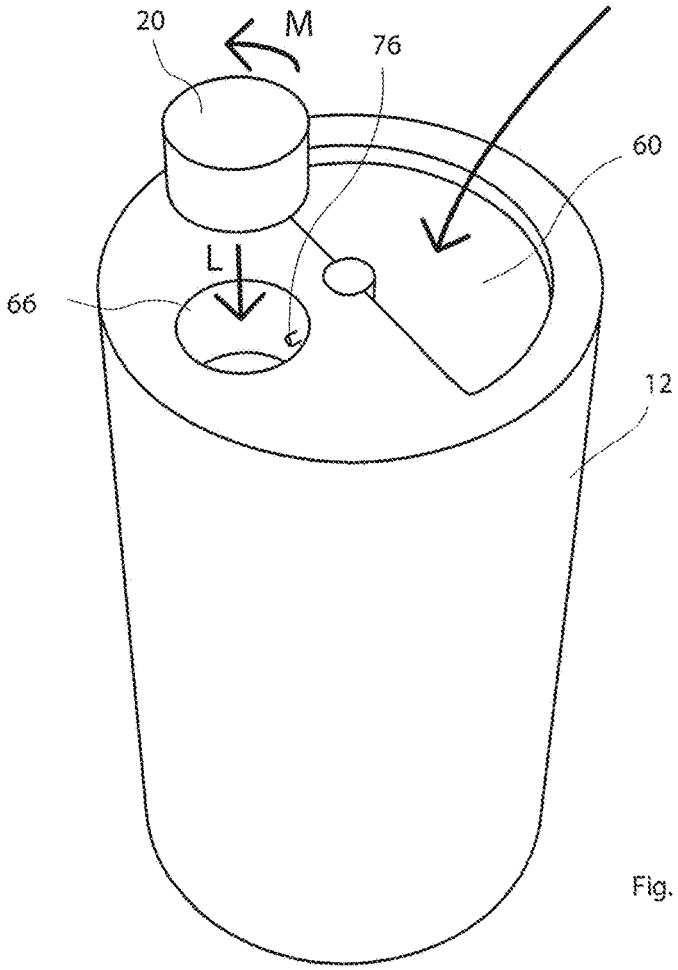
Figure 20A:
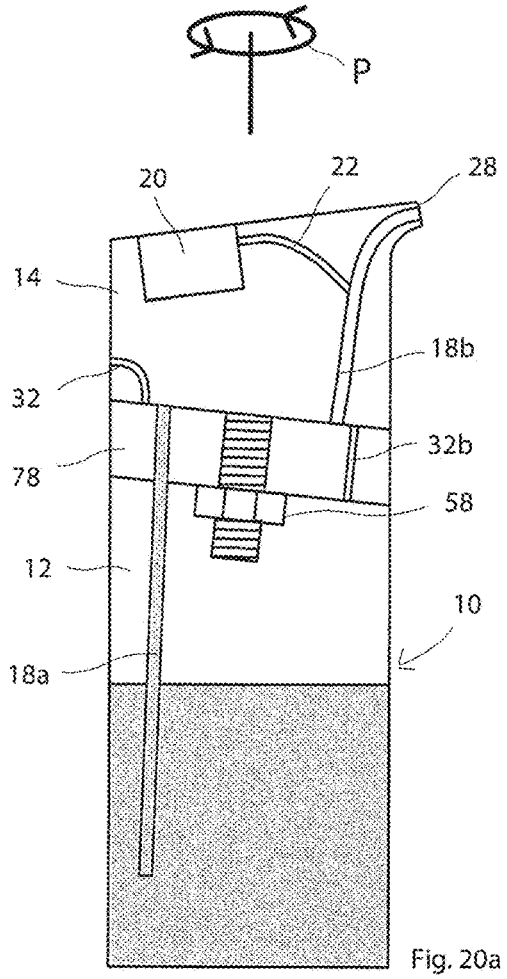
Figure 20B:
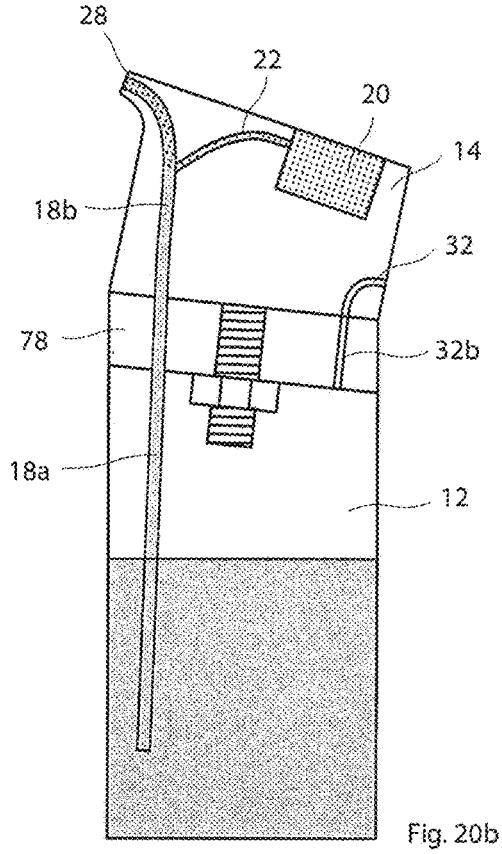
Figure 23B:
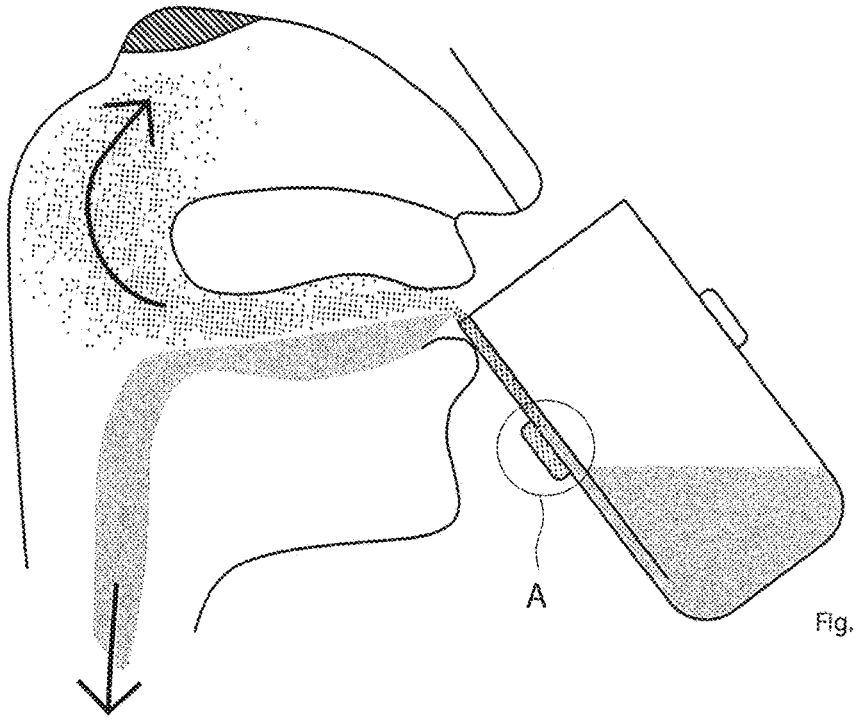
Figure 21:
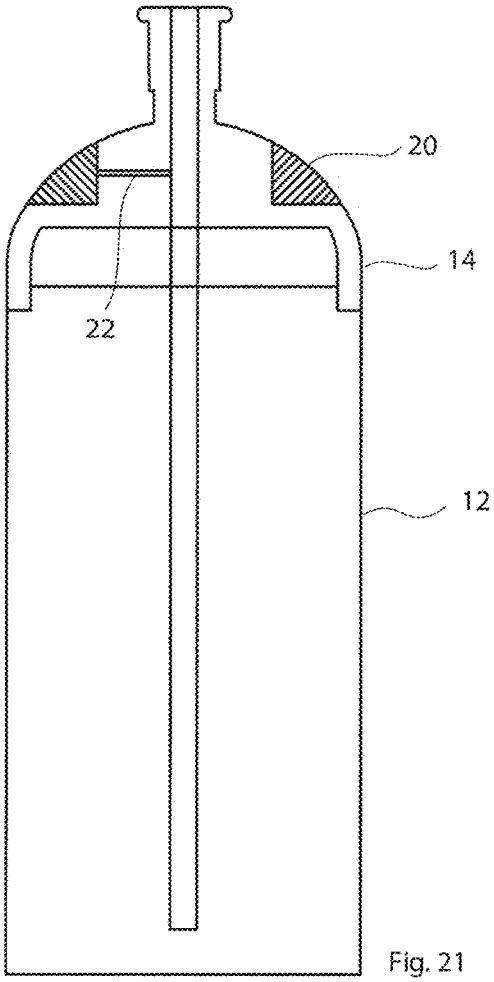
Figure 22:
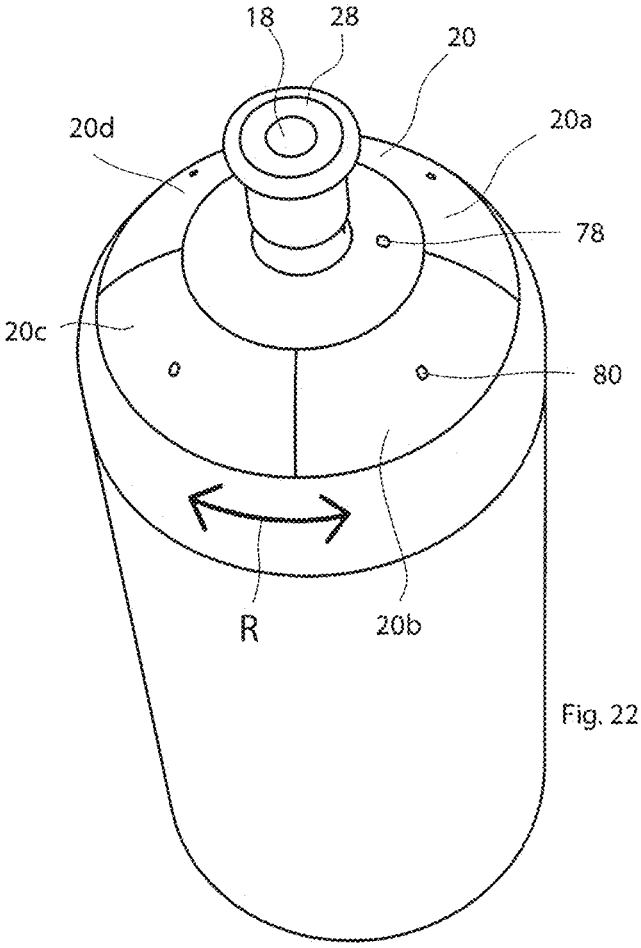
Figure 23A:
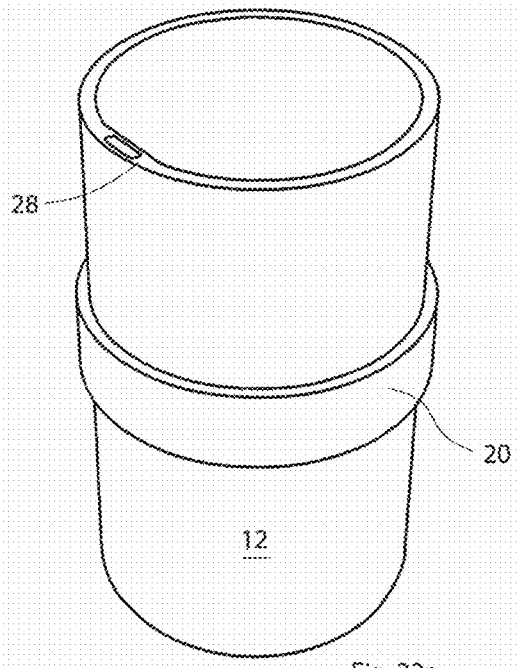
Figure 23C:
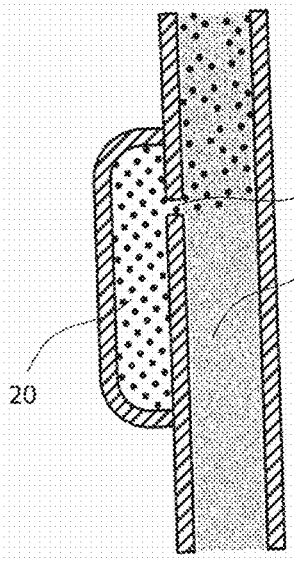
Figure 24A:
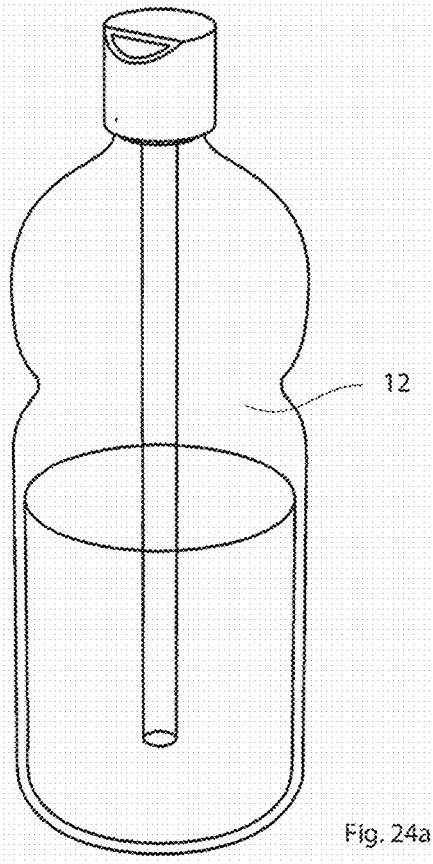
Figure 24B:
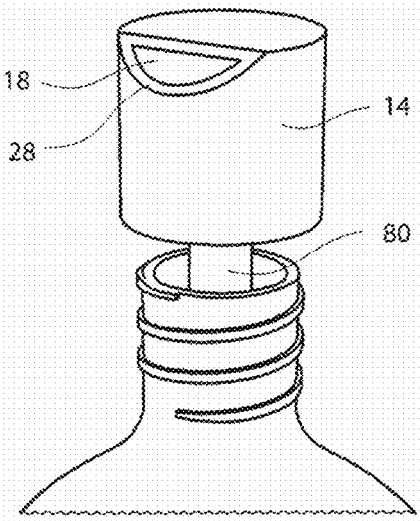
Figure 25A:
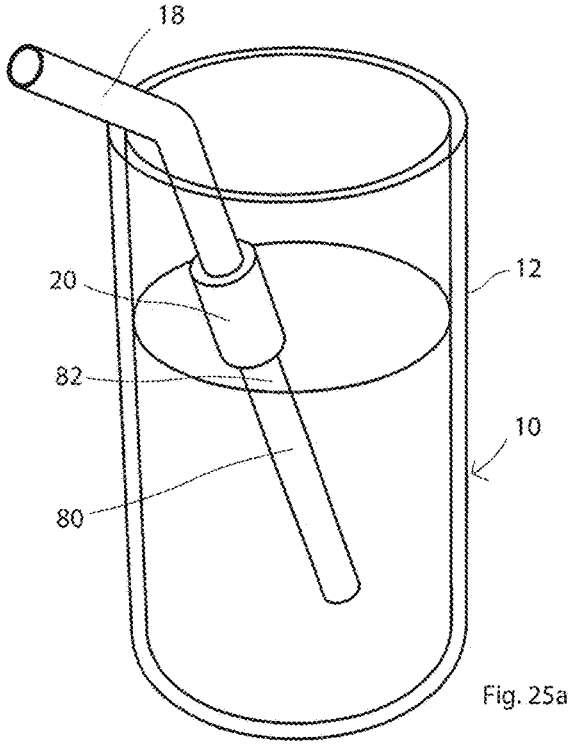
Figure 25B:
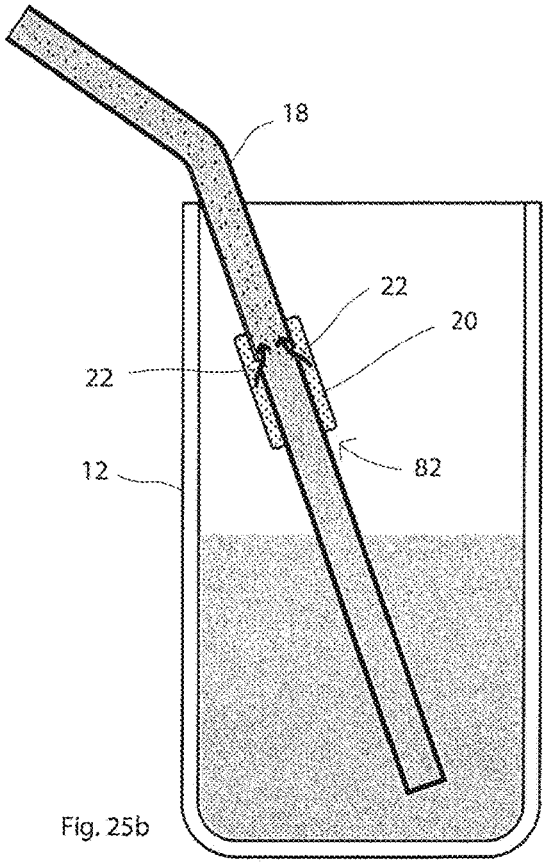
Figure 26A:
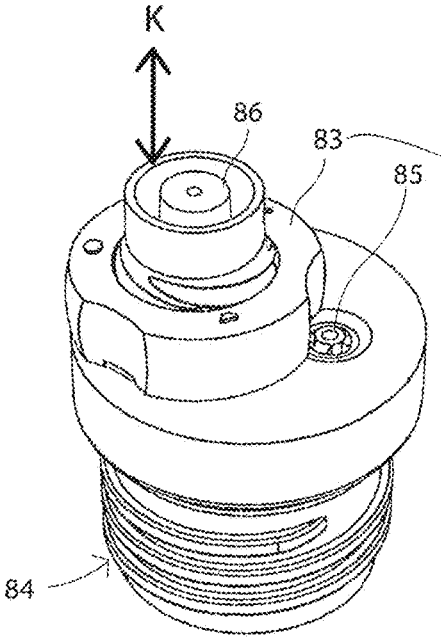
Figure 26B:
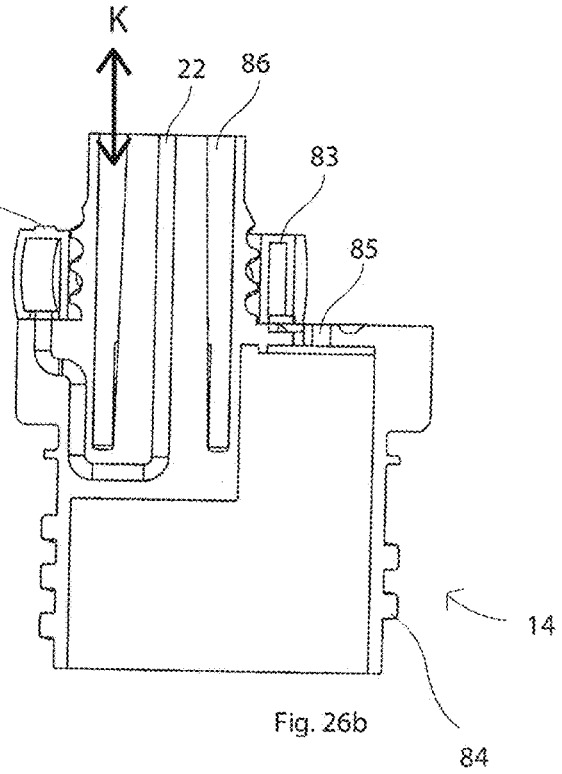
Figure 27A:
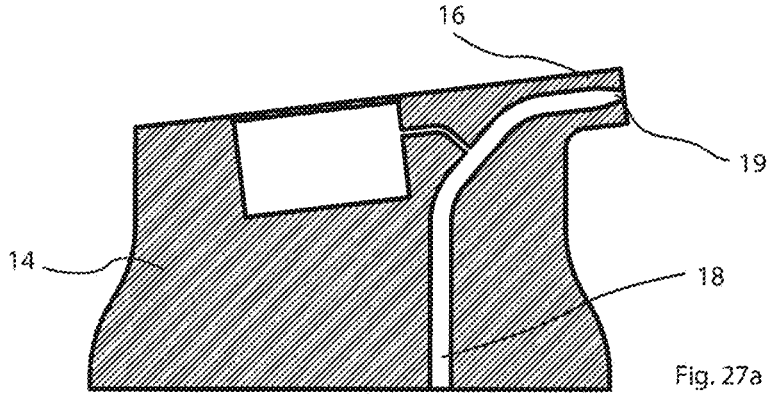
Figure 27B:
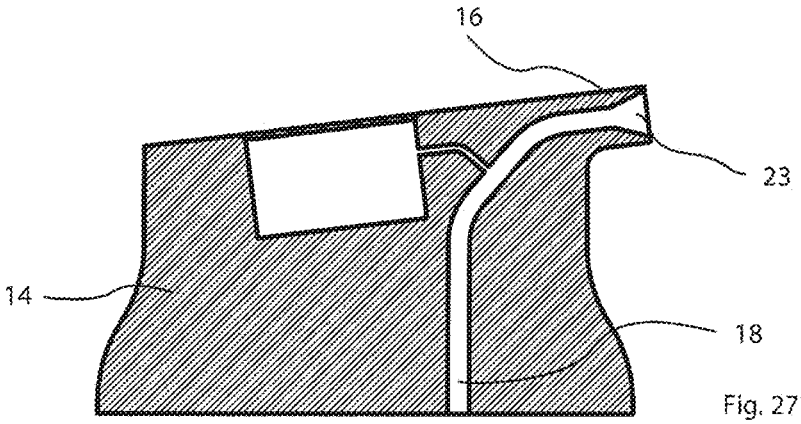
Figure 31:
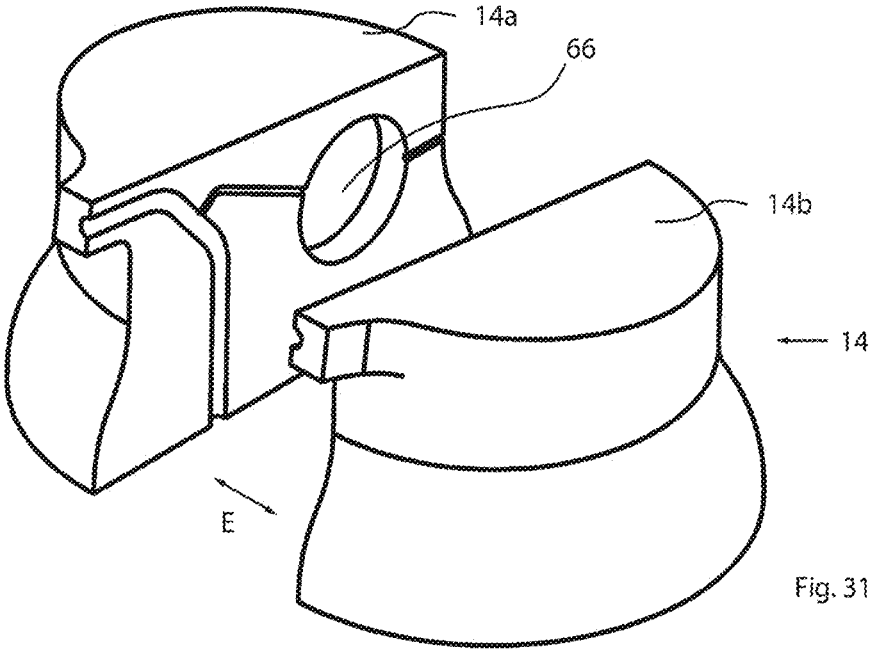
Figure 28A:
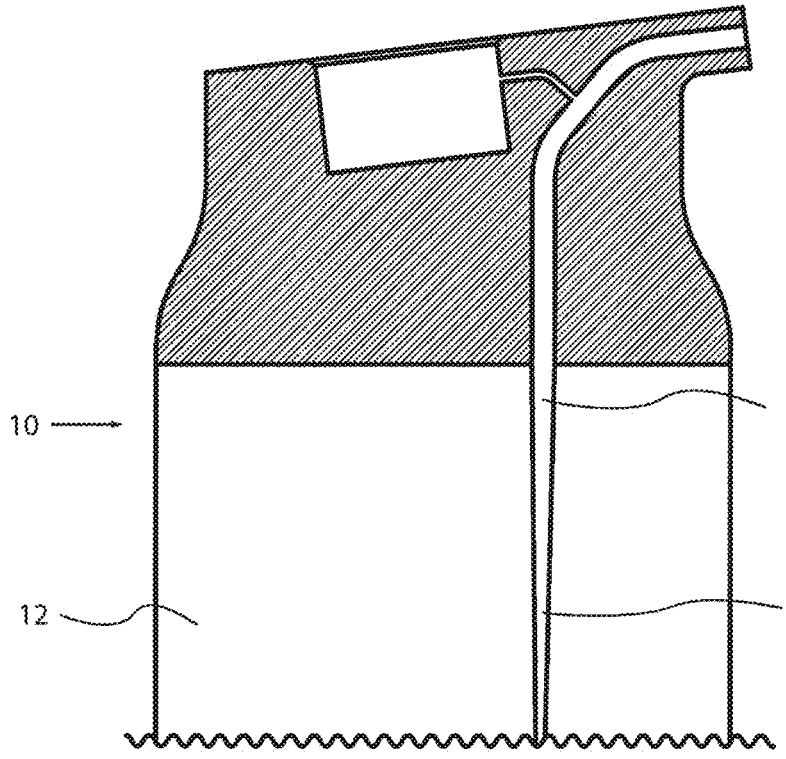
Figure 28B:
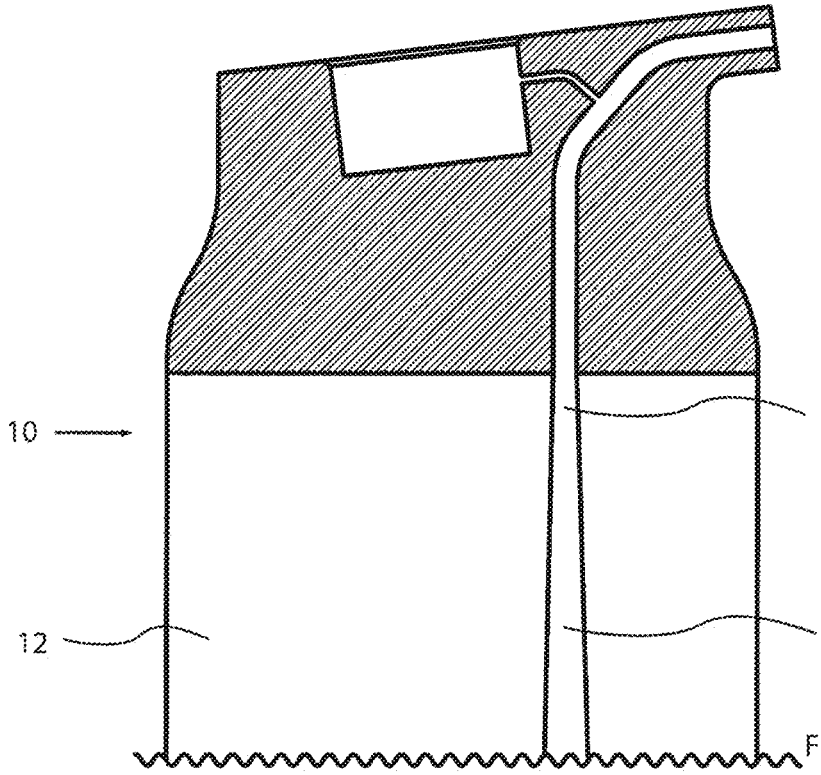
Figure 29:
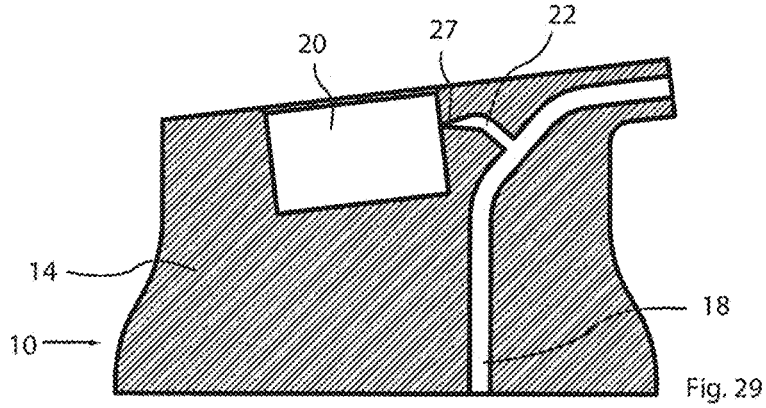
Figure 32A:
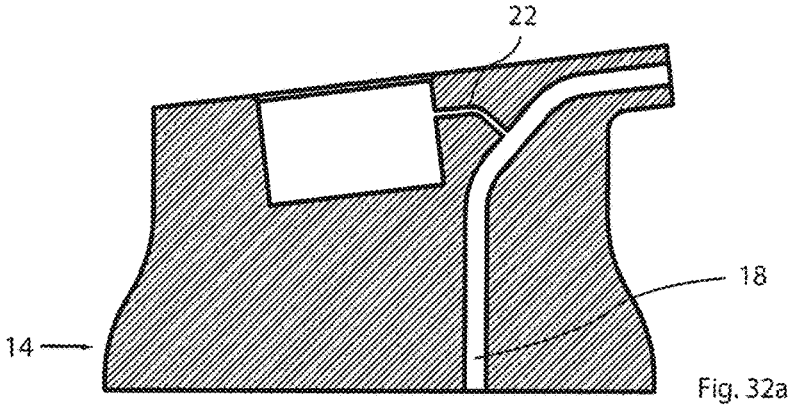
Figure 32B:
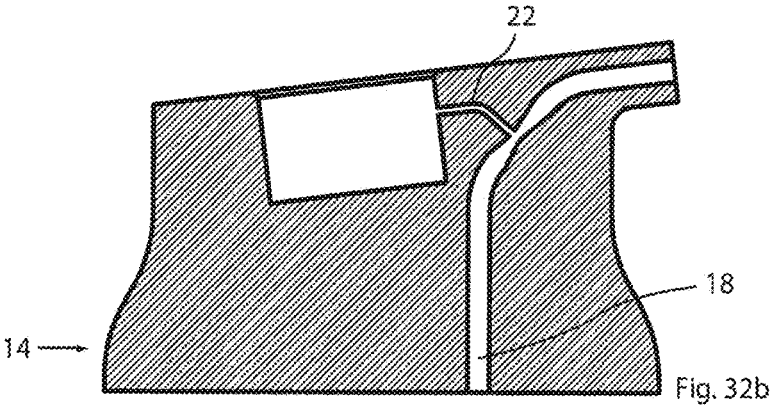
Figure 32C:
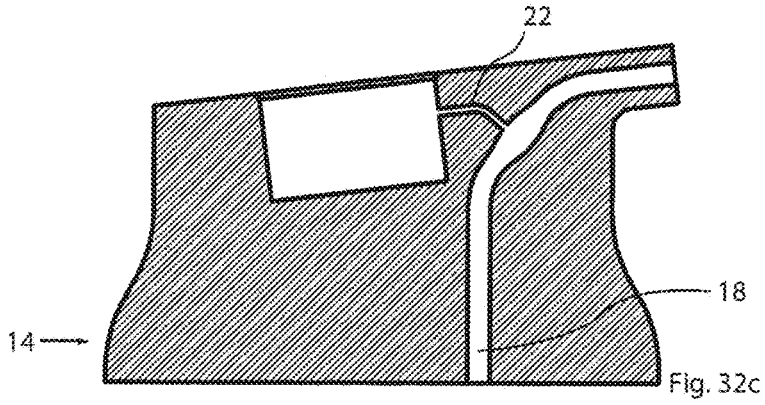
Figure 30A:
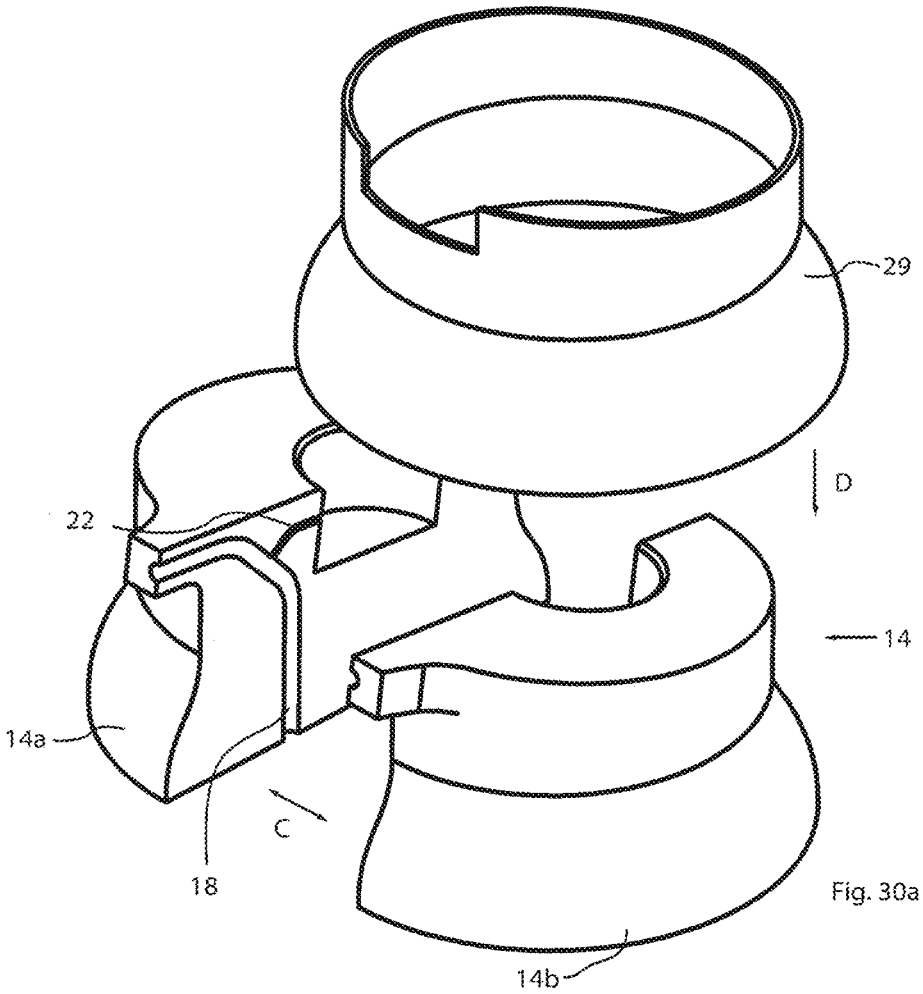
Figure 30B:
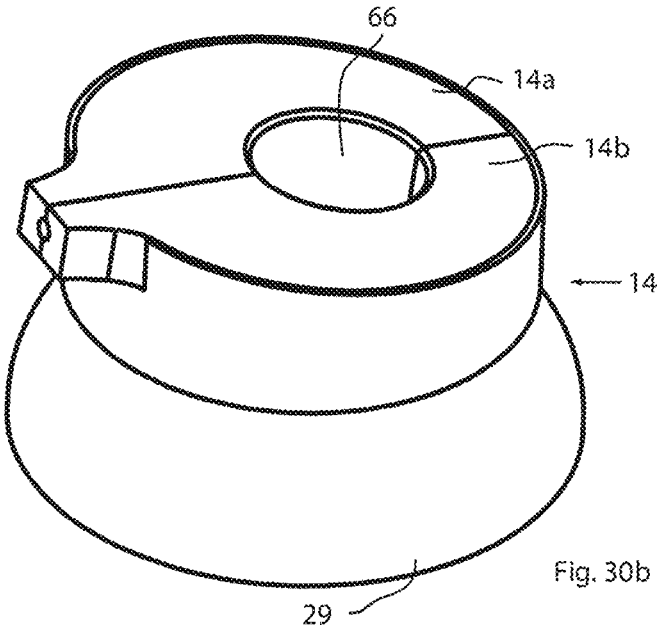
Figure 33A:
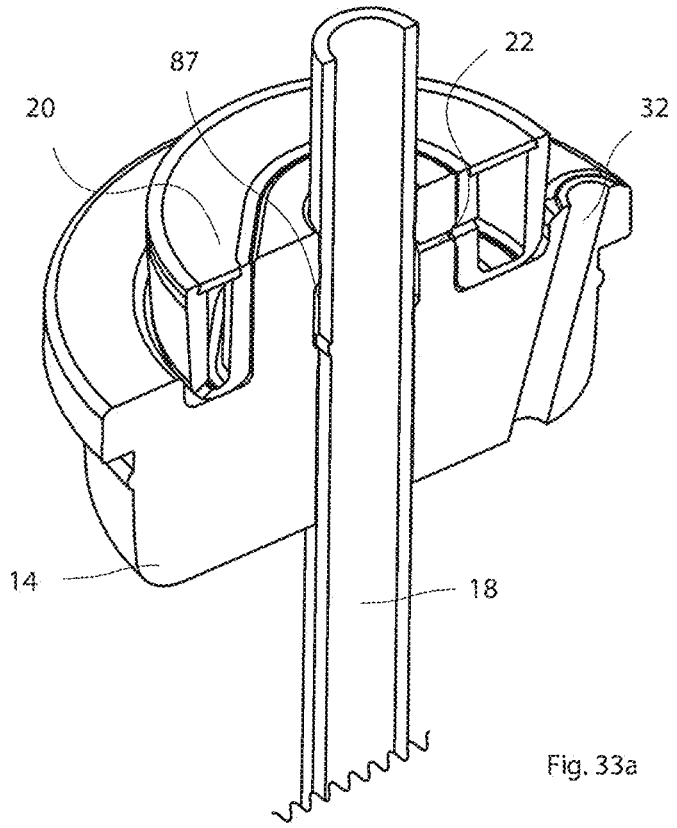
Figure 33B:
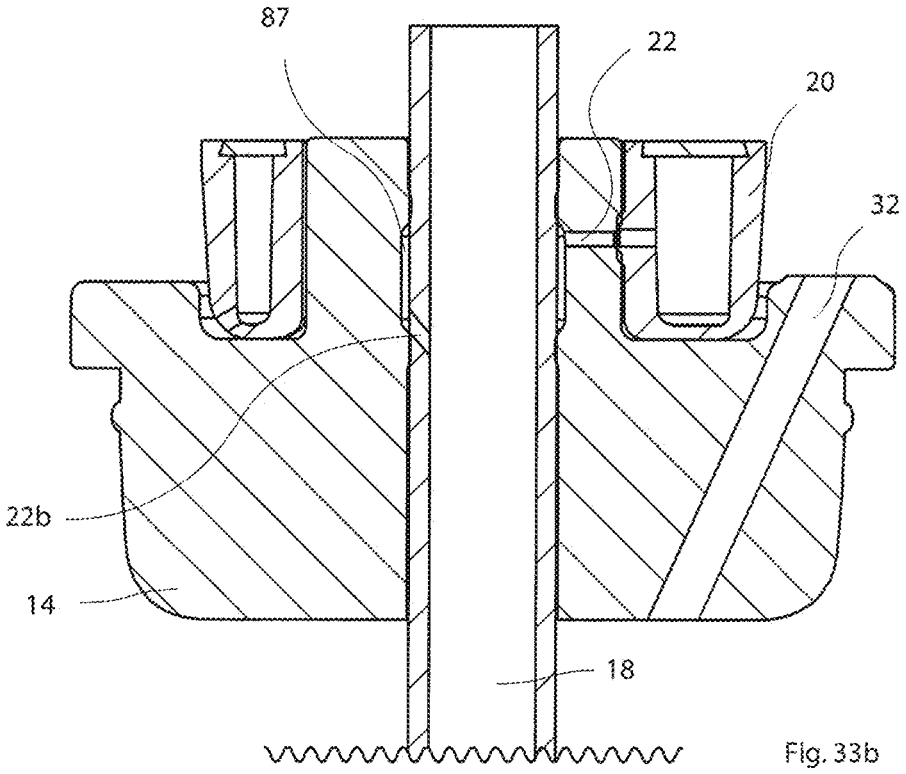

The invention is described below purely on the basis of the attached schematic illustrations, where FIG. 1 schematically presents a first possibility of the mouthpiece technology of a drinking device according to the invention for the retronasal perception of an aroma substance;

FIG. 2 shows an alternative mouthpiece technology of a drinking device according to the invention for the retronasal perception of an aroma substance;

FIG. 3*a* and FIG. 3*b* show the use of a pivotable mouthpiece in the drinking device according to the invention;

FIG. 4*a* and FIG. 4*b* present cross-section views showing a pressure equalization valve in the opened and in the closed state;

FIG. 5 schematically presents a slide valve;

FIG. 6 shows a sectional value through the drinking device according to the invention with a rotating lid sealing the drinking device tightly;

FIG. 7 schematically presents a drinking device according to the invention with a seal designed as a pull valve;

FIG. 8 schematically presents the use of a rotary plug by a user;

FIG. 9 schematically presents the function of an integrated valve with separately running transporting channel for drinking liquid and air channel for transporting aromatized air;

FIG. 10 schematically presents the function of an integrated valve with serially running transporting channel for drinking liquid and air channel for transporting aromatized air;

FIG. 11*a* and FIG. 11*b* present the sealing of the transporting channel for drinking liquid and the air channel for transporting aromatized air by means of the position of the aroma container;

FIG. 12*a*, FIG. 12*b*, FIG. 12*c* and FIG. 12*d* schematically present top views of the storage container of the drinking device according to the invention on which a head part can be fitted and in which different arrangements for the filler opening for drinking liquid and the receptacle of one or more aroma containers are presented;

FIG. 13 schematically presents a possibility for identifying the aroma containers used;

FIG. 14*a* and FIG. 14*b* present a detail view and exploded view of an aroma mixer integrated into the drinking device;

FIG. 15 schematically presents the use of an aroma container for the individual composition of an overall aroma consisting of individual aromas;

FIG. 16 schematically presents an aroma container which is suitable for insertion into a correspondingly formed bayonet mount;

FIG. 17 schematically explains the insertion of the aroma container presented in FIG. 16 into a drinking device according to the invention;

FIG. 18*a* and FIG. 18*b* present an individual aroma mouthpiece and an aroma mouthpiece on a drinking device according to the invention;

FIG. 19 presents a schematic sectional view of an aroma mouthpiece which can be attached to a drinking device;

FIG. 20*a* and FIG. 20*b* present the arrangement of an aroma container on the head part of a drinking device according to the invention, and the use of the head part;

FIG. 21 presents a schematic sectional view through a drinking device according to the invention using an aroma ring;

FIG. 22 presents a schematic top view of a drinking device according to the invention with an aroma ring separated into individual segments;

FIG. 23*a*, FIG. 23*b* and FIG. 23*c* present an embodiment of a drinking device according to the invention which is designed as an open drinking vessel, whereby FIG. 23*a* presents a schematic external view, FIG. 23*b* schematically shows the use of the drinking device according to FIG. 23*a* and FIG. 23*c* presents the section marked with A in FIG. 23*b* in an enlarged view;

FIG. 24*a* schematically presents a drinking device according to the invention combined as a bottle top with a conventional drinking bottle;

FIG. 24*b* reproduces the bottle top schematically in an enlarged view;

FIG. 25*a* and FIG. 25*b* show a drinking device according to the invention using a straw, and a sectional view through the straw in order to illustrate the principle of action;

FIG. 26*a* and FIG. 26*b* present a mouthpiece for a drinking device according to the invention which allows the bottle to be turned upside down;

FIG. 27*a* and FIG. 27*b* schematically present modifications according to the invention of the geometry of the liquid channel in the head part;

FIG. 28*a* and FIG. 28*b* schematically present by way of example a modification according to the invention of the geometry of the liquid channel;

FIG. 29 schematically presents a preferred form of the air channel;

FIG. 30*a* and FIG. 30*b* show a preferred form which schematically and by way of example contains a separable head part;

FIG. 31 shows a preferred form of the separable head part with internal aroma container;

FIG. 32*a*, FIG. 32*b* and FIG. 32*c* show various preferred forms of the head part of the drinking device which exhibit modified geometries at the point at which the fragrance channel enters the liquid channel; and FIG. 33*a* and FIG. 33*b* schematically show a preferred embodiment of the head part of the drinking device, said head part containing a device which prevents the ingress of liquid into the air channel.

DESCRIPTION OF PREFERRED EMBODIMENTS

In the following embodiments the same construction elements are always designated with the same reference numbers.

FIG. 1 is a schematic representation of a drinking device 10 which in the following exemplary embodiment comprises a storage container 12 filled with a drinking liquid, and a head part 14. Herein a pure drinking liquid is always understood to mean that drinking liquid which does not contain an aroma added through the drinking system according to the invention. The head part 14 comprises a mouthpiece 16 which in this case is integrated in the head part but, as will be explained later based on different embodiments, can also be provided separately. In the head part 14 is an aroma container 20 which is in fluid connection with the ambient air in a manner not illustrated and from which an air channel 22 for transporting aromatized air leads away. Also provided is a transporting channel 18 for drinking liquid, which in this exemplary embodiment extends like a straw into the pure liquid contained in the storage container 12.

In the embodiment according to FIG. 1 the transporting channel 18 for drinking liquid and the air channel 22 for transporting aromatized air are connected in series, i.e. the air channel 22 runs into the transporting channel for drinking liquid, in the portion 18*a* whereof are consequently located both a pure liquid sucked in by the user via the mouthpiece 16 and air bubbles with aromatized air.

When the drinking device 10 according to the invention is used, both the pure liquid and the aromatized air are taken in orally. In the oral cavity the liquid phase and the gas phase separate and the gaseous aromatized air proceeds via the retronasal route 24 in the direction of arrow A to the olfactory mucosa 26, where the aroma is detected by the receptors which are located in the olfactory mucosa and the user is given the impression, via the neuronal processing of the sensory stimuli, that the pure liquid which the user is drinking (direction of arrow B) has the flavour added by the aroma.

In the solution illustrated in FIG. 1 it is important that the aromatized air runs into the transporting channel 18 for drinking liquid as directly as possible at the mouthpiece 18, so that contact between the aromatized air and the pure liquid during drinking is as brief as possible. In this manner an undesired mass transfer of aroma substance between the air and the pure liquid is minimized, although an absorption of the aroma in the liquid cannot be excluded with 100% certainty. The briefer the contact between the air and the liquid, but also the smaller the total interface between the air and the liquid, the less the undesired mass transfer.

The arrangement according to FIG. 2 has proven to be advantageous for keeping the undesired mass transfer as low as possible. Here the transporting channel 18 for drinking liquid and the air channel 22 for transporting aromatized air are arranged parallel to one another, i.e. no mixing at all occurs before the mouth end 28. The remaining components and the active principle correspond entirely to those according to the embodiment presented schematically in FIG. 1.

In the embodiment presented in FIG. 2, the illustration also shows that the mouth end extends a certain distance into the oral cavity of the user when the device is used as intended. In the representation according to FIG. 2, however, the extension is shown with exaggerated length for the sake of clarity. The advantage of an extension of the mouth end 28 into the oral cavity consists in that the least possible mixing between the aromatized air and the pure liquid occurs. In the same manner it is, of course, also possible for the mouth end 28 to be in the area of the lips of the user when the device is used as intended.

In the embodiment presented in FIG. 2, the air channel 22 for transporting aromatized air and the transporting channel 18 for drinking liquid extend the same distance into the oral cavity of the user, i.e. the transporting channel 18 and the air channel 22 both end at the same place on the mouth end 28. Given the parallel arrangement of the transporting channel 18 and the air channel 22, however, this need not necessarily be the case, and one of the two channels can extend less far into the oral cavity of the user than the other. Two variants are therefore feasible.

According to the first variant, the air channel 22 extends further into the oral cavity than the transporting channel 18 for the drinking liquid. With this variant, which is not illustrated, the user has the feeling that they are ingesting the drinking liquid directly at the lips via the mouthpiece of the bottle. However, the aromatized air is introduced less far into the oral cavity and hence is only very briefly in contact with the pure liquid, so that a mass transfer between the aromatized air and the pure liquid can be almost excluded. Furthermore, the geometry and the length of the individual channels can also be technically conditioned in order to enable the most even possible intake of pure liquid and aromatized air during the drinking process.

Alternatively to the variant described above, however, it is also possible for only the transporting channel 18 for drinking liquid to be extended further into the oral cavity of the user, whereas the air channel 22 for transporting aromatized air ends in the area of the lips of the user when the user is drinking from the drinking device according to the invention. This measure likewise serves to keep the contact time between the aromatized air and the drinking liquid as brief as possible and has the advantage that the aroma can already develop in the pharynx of the user.

For the drinking device according to the invention to be used sensibly, it must be ensured firstly that the aroma does not escape in an undesirable manner while the drinking device is being stored, and also that a liquid in a drinking device already filled with pure drinking liquid cannot run out. Furthermore, the drinking device must still have between the interior of the storage container for drinking liquid and the external atmosphere an air channel which serves to equalize the pressure and which introduces a volume of air into the drinking device corresponding to the volume of drinking liquid withdrawn from the drinking device during drinking. This air channel should likewise be provided with a suitable shut-off device so that no drinking liquid can escape undesirably.

FIGS. 3*a* and 3*b* present an embodiment in which the mouthpiece is arranged so as to pivot around an axis of rotation 30 on the drinking device 10 and so as to move back and forth in the direction of arrow C between the drinking position represented in FIG. 3*a* and the sealed position represented in FIG. 3*b*. To that end the mouthpiece is provided with a continuation 18*b* of the transporting channel 18 for drinking liquid and a continuation 22*b* of the air channel 22 for transporting aromatized air, said continuations being only flush with the channels 18 and 22 in the drinking position represented in FIG. 3*a*, so that the user can take in drinking liquid and aromatized air through the mouthpiece 16. As illustrated in FIG. 3*b*, in the closed state a positive fit is created between the drinking device 10 and the mouthpiece 16, whereby a refined aesthetic impression is created.

Deviating from the embodiment schematically presented in FIG. 3*b*, it is also possible to modify the mouthpiece 16 and the receptacle geometry provided for the mouthpiece in the closed state such that in the sealing state the continuations 22*b* and 18*b* of the transporting channels 22, 18 are not open to the outside, so that in the phases in which the drinking device is not used no undesired substances can get into the mouthpiece 16 from the outside.

FIGS. 4*a* and 4*b* are schematic presentations of a possible embodiment of an equalization valve for the air channels 32 for delivering air for the purposes of pressure equalization. A check valve is used in this case.

Such a check valve can comprise an elastic construction element 34 which on the one side is fixed in a wall 36 of the drinking device according to the invention and on the other is provided with an elastic sealing plate 38 which, in the case of an underpressure, as represented in FIG. 4*a*, deforms under the influence of the increased external pressure such that in the direction of arrow D air can flow through the air channel 32 into the interior of the storage container. If, as represented in FIG. 4*b*, the pressure is equalized, the sealing plate 38 then lies tight against the wall 36 from the inner face of the container and seals the air channel 32, so that, as represented in FIG. 4*b*, no outside air can flow in the direction of arrow E into the interior of the storage container 12 and at the same time no liquid can flow out through the air channel 32. Should the pressure prevailing in the interior of the storage container be greater than that of the external atmosphere for any reason, the same situation as represented in FIG. 4*b* arises and the undesired exit of liquid or air from the interior of the container is prevented.

The embodiment presented in FIG. 5 is a variant of the solution presented in FIGS. 3*a* and 3*b* using a rotatable mouthpiece. In the embodiment according to FIG. 5, the mouthpiece 16 can be moved in the direction of arrow F and back again and, as presented in FIG. 5, protrudes a certain distance out of the head part 14 of the drinking device 10 when the drinking device is in the drinking position. To enable the mouthpiece 16 designed as a slide to be moved, it can be provided in a suitable manner with a gripping aid in the form of fluting (not represented) on the top side. The embodiment according to FIG. 5 is a very elegant solution, since after the drinking process the mouthpiece 16 is moved against the direction of arrow F until the mouth end 28 can close flush with the peripheral surface of the head part 14, which also indicates directly to the user whether the drinking device is in an open or a closed state. The solution according to FIG. 5 can be technically realised by extending the transporting channels 18 and 20 in the direction of the mouthpiece in the axial direction of the drinking device and making them flush with the continuations of the transporting channels 18 and 22, said continuations being arranged in the mouthpiece 16, only when the mouthpiece is in the pushed-out position represented in FIG. 5. This could, for instance, be achieved through the use of a cam, so that the opening and closing are enabled by a rotational movement.

FIG. 6 represents another embodiment of the invention using a rotating lid 40 which is screwed onto the storage container 12, whereby the mouth end 28 closes tightly with the transporting channel 18 for drinking liquid and the air channel 22 for transporting aromatized air to the outside. The rotating lid 40 can also extend sufficiently far over the storage container 12 that, when the lid is screwed on, an entry opening not represented in FIG. 6 to the air channel for the pressure equalization is sealed at the same time. The advantage of a lid also consists in that it protects the mouth end 28 from contamination and, due to the pressure resistance of a screw connection, it is also suitable for reliably sealing the drinking device filled with a carbonated liquid 42.

The variant of a sealing device presented in FIG. 7 comprises a pull valve 44 which is arranged in the head part 14. If the user pulls the pull valve out in the direction of arrow G, the drinking device 10 opens for drinking. To seal tightly, the pull valve 44 is pressed back into the head part against the direction of arrow G. The position of the mouthpiece designed as a pull valve 44 enables the user to identify that they do not have to tilt the bottle in order to drink. The user could also be given a clear indication, perhaps by means of a coding/marking with different colours, that the pull valve is in the withdrawn position and the drinking device is thus not closed tightly.

FIG. 8 is a schematic presentation of a further solution using a rotary plug. The rotary plug 38 can be used both as a sealing device and as a throttle device for throttling the volumetric flow rate of drinking liquid led through the transporting channel 18 as well as the volumetric flow rate of aromatized air led through the air channel 22. The rotary plug schematically represented in FIG. 8 is rotatably arranged in the head part of the drinking device and can be moved by the user in the direction of rotation H in that the user operates the hand wheel 50. Part of the rotary plug 46 is a shaft 52 rotatably led in the housing, said shaft containing through openings 48*a* and 48*b* which in the orientation presented in FIG. 8 are not flush with the transporting channel 18 for drinking liquid and the channel 20 for transporting aromatized air. If, however, the shaft 52 is rotated around about 90° by an actuation of the rotary plug 46 in the direction of rotation H with the openings 48*a* and 48*b*, the openings 48*a* and 48*b* are flush with the channels 22 and 18, so that the flow connections are open. However, by operating the rotary plug the openings 48*a* and 48*b* can also be brought into a position in which only a part of the opening cross-section of the openings 48*a* and 48*b* is available for the flow of air and liquid. In this manner the rotary plug can also be used for throttling.

The ratio of drinking liquid and aromatized air can be varied through the alternative use of a rotary plug 46 with channels arranged in an x shape. To that end the openings 48*b* in the rotary plug and the channels arranged in an x shape for transporting drinking liquid exhibit the same flow cross-section, whereas the channels arranged in an x shape for transporting aromatized air exhibit different flow cross-sections. As schematically presented in the detail views in FIG. 8, the opening 48*a* and the channel connecting to it have a greater flow cross-section than the opening 48*c* and the channel connecting to it. As a consequence, by selecting the rotary position of the rotary plug a user can on the one hand close the transport channel 18 and the air channel 22, and on the other set different flow cross-sections for the air channel 22 while the transporting channel 18 for the drinking liquid is open and hence throttle the volume of aromatized air.

The advantage of the rotary plug thus consists in that the flow rate can be adjusted infinitely and each user intuits the operation of the closing device.

According to a further embodiment not presented, a sports valve can be provided with which the mouthpiece is pushed in an axial direction between the closed and the opened position, similarly to the embodiment according to FIG. 7. In addition to the transporting channel 18 for drinking liquid and the air channel 22 for transporting aromatized air, the air channel 32 for pressure equalization can also be simultaneously opened and closed with the operation of the mouthpiece. As with the sports valves known in the prior art and the trade, the mouthpiece is withdrawn when the drinking device is to be put into the drinking state and correspondingly pushed in the direction of the storage container again when the drinking device is to be closed tightly. In contrast to the known drinking vessels with a sports valve, however, it is not necessary to turn the drinking device upside down when drinking, since the drinking liquid and the aromatized air are sucked in by the user.

The use of an integrated valve is illustrated in FIGS. 9 and 10. In FIG. 9, the integrated valve is represented with the air channel 22 for transporting aromatized air running separate from the transporting channel 18 for drinking liquid, whereas in FIG. 10 the transporting channels 18 and 20 are connected in series, as was presented schematically in FIG. 1.

Looking at FIG. 9, it is clear that the mouthpiece 16 of the drinking device can be withdrawn and pushed in again in the direction of arrow J relative to the head part 14. In the pulled-out state represented in FIG. 9, the transporting channel 18 and the air channel 22 are open, so that the drinking device can be drunk from. The air channel 32 for pressure equalization is open at the same time. If the mouthpiece 16 is pushed onto the head part 14 until the mouthpiece 16 is firmly in contact with the head part 14, the opening of the air channel 32 is sealed tightly with the lip 54 on the mouthpiece 16. Since the mouthpiece 16 is offset relative to the head part, the flow connection from the head part to the mouthpiece is also interrupted at the point where the air channel 22 enters the mouthpiece 16, so that the air channel 22 is closed. In addition, the movement in the direction of arrow K also causes the transporting channel 18 for drinking liquid to be closed, so that the transporting channel 18 for drinking liquid, the air channel 22 for transporting aromatized air and the air channel 22 for pressure equalization can be opened and closed simultaneously with the aid of the integrated valve represented in FIG. 9. The shape of the mouthpiece represented in FIGS. 9 and 10 in the area of the mouth end is only represented schematically and can of course have any desired and ergonomic form for the user.

A locking of the mouthpiece 16 in the closed position can be implemented using positive-locking elements in the form of locking nipples 15*a* and 17*a* and corresponding recesses 15*b* and 17*b*, for example, which are represented in FIG. 10.

The design according to FIG. 10 differs from that according to FIG. 9 only in that the air channel 22 for transporting aromatized air is not led up to the mouth end 28 in the mouthpiece 16, but instead runs into the transporting channel 18 for drinking liquid in the area of the mouthpiece. Otherwise, however, the embodiment according to FIG. 10 does not differ from that according to FIG. 9, so that with respect to the active principle of the sealing device reference can be made entirely to the explanations for FIG. 9.

The embodiments according to FIGS. 11*a* and 11*b* integrate the sealing device into the aroma container 20. The aroma container 20 is pressed with the aid of a finger in the direction of arrow L against the compressive force of a spring 56 in order to bring the continuation 18*b* of the transporting channel 18 for drinking liquid, said continuation being provided in the aroma container 20, into the flush connection presented in FIG. 11*b* with the portions 18*a* and 18*c* of the transporting channel for drinking liquid. It is conceivable that the liquid connection through the transporting channel 18 only exists for as long as a user actually presses their finger on the aroma container 20 from the outside. In the same manner, however, it is also possible to provide an engagement position, comparable to the locking function of a ball-point pen, so that, as indicated with the double arrow L in FIG. 11*b*, renewed pressing returns the aroma container to the initial position represented in FIG. 11*a*.

According to an alternative embodiment not represented, however, it is also possible to insert the aroma container rotatably instead of the translational motion L represented in FIGS. 11*a* and 11*b*, so that the container can be rotated between a locked position and at least one drinking position using a rotary plug, comparably to the solution represented in FIG. 8. By varying the angle of rotation, a different opening of the aroma container having a different cross-section size could be fluidly connected with the air channel 22. This would allow the volume of aromatized air and hence the intensity of flavour to be controlled. It would be conceivable, for instance, to have the positions "off", "medium" and "strong", whereby in this example an aroma container with two holes of different sizes would be required. In the third position in the example, the air channel 22 would be sealed, so that it would be possible to drink the liquid without the delivery of air and without added aroma. The advantage of this solution also consists in that the aroma container is simultaneously the seal, so that a smaller quantity of components is required.

According to a further embodiment not presented, a shut-off device can also be configured by means of a squeezing unit. To this end a portion of the channel to be sealed, for instance of the transporting channel for drinking liquid, must be provided with a flexible tube which is squeezed together, for instance by means of a wheel arranged in a groove so as to be rotatably moveable, so that the flow connection is throttled or interrupted. The technical solution meets the hygienic requirements because there is no direct contact between the shut-off wheel and the substance led in the transporting channel. This solution is therefore also used in the medical industry, for example, in order to adjust the transport volume of infusion liquids. If the actuating wheel is recessed as far as possible in the head part of the drinking device, this technical solution allows a low construction to be realised.

For simplicity of representation, only a single aroma container, arranged in the head part of the container, was provided in the embodiments represented above.

Common to all embodiments is that the drinking device can be configured such that, for example, in the base of the drinking device can be located a further receptacle geometry for at least one further aroma container which can replace the existing aroma container as soon as the aroma container in operation is exhausted or the consumer wishes to change the taste profile. FIGS. 12*a*, 12*b*, 12*c* and 12*d* present embodiments each of which schematically shows a top view of the storage container 12, which can be rotatably connected to a head part not presented in FIGS. 12*a* to 12*d* by means of a rotary connection 58 arranged centrally. The top view shows that each storage container 12 contains a filler opening 60 for drinking liquid. In the embodiments according to FIGS. 12*b* and 12*c* only a single aroma container 20 is provided, whereas in each of the embodiments according to FIGS. 12*a* and 12*d* three aroma containers 20 are inserted, whereby another quantity of aroma containers is also possible.

The corresponding receptacles 66 for the aroma containers 20 can be seen in FIG. 13. As can also be seen in FIG. 13, the aroma containers 20 can be provided with a marking lug 62 which enables the aroma containers 20 to be withdrawn after the aroma containers 20 have been inserted flush into the corresponding receptacle 66 in the storage container 12. Furthermore, the marking lugs 62 can be arranged such that they extend beyond the storage container 12 and can thereby give the user information about the aroma profile inserted.

If multiple aroma containers are provided, rotation of the head part not presented in FIGS. 12*a* to 12*d* and FIG. 13 relative to the body of the storage container 12 allows a choice to be made between the individual aroma profiles. To that end the head part is provided with corresponding markings or an engagement mechanism not presented by means of which a user can establish the flow connection of the air channel 22 from one of the multiple aroma containers to the mouthpiece of the drinking device. In this manner the taste profile can be changed even while drinking. Likewise, however, pure liquid can also be consumed by the deliberate arrangement of the head part in a position in which there is no continuous connection of any of the air channels 22.

In contrast to the embodiments according to FIGS. 12*a* to 12*d* and FIG. 13, with the embodiments presented in FIGS. 14*a* and 14*b* a mixture of individual aromas can be established. To that end, between the storage container 12 and the head part 14 with mouthpiece 16 is arranged a mixing unit 64 which in the exemplary embodiment according to FIG. 14*a* comprises three different receptacles for aroma container 20, which are each inserted in the mixing unit 64 configured as an intermediate plate. Thus, from various aroma substances can be produced a mixed aroma which is sucked in via the mixing ring 68 and is delivered to the mouthpiece by means of the air channel 22 connected to it in the head part 14.

The technical solution presented in FIGS. 14*a* and 14*b* offers the advantage that a user can establish their own taste combinations.

FIG. 15 shows an alternative design in which the aroma container 20 is divided into individual segments 20*a*, 20*b* and 20*c* and is closed upwards by means of a lid 70. A user can undertake a free composition of the individual aromas which are inserted into the individual segments 20*a*, 20*b* and 20*c* and from which a mixture is created.

Where the above description mentions different aromas, this term also encompasses individual aromas which contain the same taste profile, but have a different intensity of flavour.

The embodiment according to FIG. 16 outlines a possible way of attaching an aroma container 20 which is provided with a spring 56 on its underside. The peripheral wall of the substantially circular-cylindrical aroma container 20 has in addition to the scent hole 72 presented here a guide 74 which is a groove having two portions arranged at an angle to one another. The first portion 74*a* runs parallel to the axis of rotation of the circular-cylindrical aroma container, whereas the second portion 74*b* adjoins the first portion 74*a* and runs in a circumferential direction up to an end face 74*c*. A possible associated storage container 12 is represented in FIG. 17 and has similarities to the geometry represented in FIG. 12*c*, with a filler opening 60 formed substantially in the shape of a semicircular segment and a receptacle 66 for the aroma container represented in FIG. 16, whereby on the peripheral wall of the receptacle 66 is located a projection 76 which is arranged and designed in order to be moved within the guide 74 during insertion. However, the storage container according to FIG. 17 could also be designed such that no bayonet connection is required between the receptacle 66 and the aroma container 20, since the aroma container is fixed in position by the attachment of a head part represented in FIG. 17.

During the insertion of the aroma container it is thus inserted in the correct angular position relative to the projection 76, initially in the axial direction L, whereby the projection 76 passes through the first portion 74*a* of the guide 74 and is subsequently moved by a rotation in the direction of arrow M relative to the receptacle 66, so that the projection 76 runs within the guide 74 in the second portion 74*b* and up to the end face 74*c*. As soon as the projection 76 is in contact with the end face 74*c*, the scent hole 72 is in flow connection with the air channel.

The embodiments according to FIGS. 18*a* and 18*b* and FIG. 19 show a separate mouthpiece 16 into which an aroma container 20 can be inserted directly, as best illustrated in FIG. 19. The aroma container in this solution need not be replaceable, as the mouthpiece itself is replaced rather than the aroma container being replaced. Replacing the mouthpiece together with the aroma container improves hygiene, also reduces the number of individual parts and simplifies the use of the drinking device according to the invention. As regards the attachment of the mouthpiece on the head part of the drinking device, any desired solutions can be used here as long as there is the necessary sealing between the mouthpiece and the head part of the drinking device.

The schematic embodiment according to FIGS. 20*a* and 20*b* shows a drinking device according to the invention which is presented as if the housing were transparent. The drinking device 10 again consists of a storage container 12 and a head part 14. The head part 14 can be rotated relative to the storage container in the direction of arrow P by means of a rotatable connection 58, which in this example is represented as a threaded bolt with locknut. The aroma container 20 is inserted in the head part and the air channel 22 for transporting aromatized air runs into the transporting channel 18*b* for drinking liquid, although this is entirely immaterial for an understanding of this embodiment since the air channel 22 could in the same manner be led parallel to the transporting channel 18*b* up to the mouth end 28.

In the event of a rotation of the head part 14 relative to the storage container 12, the portions 18*a* and 18*b* of the transporting channel for drinking liquid, but also the air channel 32 with the air channel portion 32*b* located in the head part, can be brought into flow connection, as illustrated in FIG. 20*b*, so that in the configuration represented in FIG. 20*b* the drinking device is in an operational state. Since the separating plane 78 between the storage container 12 and the head part 14 does not run perpendicularly to the cylindrical outer wall of the storage container 12 but is instead arranged at an angle to it, the position of the head part 14 changes between the sealed storage position and the drinking position, as illustrated in FIG. 20*b* as compared with FIG. 20*a*. In this manner not only is it possible to signal to the user whether the drinking device is in the drinking position, but a position that is as ergonomic as possible for drinking is also established.

In the embodiments of the drinking device according to the invention presented in FIGS. 21 and 22, an aroma container 20 is used which is configured as an aroma ring which is fitted on the head part 14 in immediate proximity to the mouthpiece 28. In the exemplary embodiment according to FIGS. 21 and 22, at the mouth end 28 is located only a single opening, namely the transporting channel 18 for drinking liquid, since, as is shown in FIG. 21, the air channel 22 runs into said channel shortly before the mouth end. In the same manner, however, with the use of an aroma ring it is also possible to lead the transporting channel 18 for drinking liquid and the air channel 22 for transporting aromatized air in parallel up to the mouth end 28.

The aroma container 20, which is designed in annular form, is divided into various segments 20*a*, 20*b*, 20*c* and 20*d* which can contain different aroma strengths or even aroma profiles. The marking 78 on the head part 14 of the container is used to indicate to the user which aroma chamber is in use. However, if the marking 78 is not aligned with the respective marking 80 on the individual chambers, in the embodiment according to FIGS. 21 and 22 the connection between the aroma container and the transporting channel 18 can also be blocked, so that a user cannot ingest drinking liquid aromatized via the system according to the invention. The aroma container could simply be inserted frictionally in a corresponding recess in the head part 14, making use particularly easy and convenient for the user.

Deviating from the embodiment represented in FIGS. 21 and 22, it is of course also possible to provide an undivided aroma ring and consequently to provide only a single taste profile for the consumer. Regardless of the number of chambers, the advantage here is the ease of use and replacement by the user, who can change the aroma during drinking if there are multiple different types of aroma, but can also bring the ring into a position in which no aroma is dosed and the air channel 22 for transporting aromatized air is also closed, so that no air bubbles get into the water, enabling a different sensation on the mouth to be achieved.

The embodiment presented in FIGS. 23*a*, 23*b* and 23*c* is a drinking device 10 which is a drinking beaker open at the top. In this embodiment the aroma container 20 is represented as a ring which surrounds the storage container 12 on its outer circumference and either is connected with the transporting channel 18 for drinking liquid via a short air channel 22 for transporting aromatized air, as illustrated in FIG. 23*c*, or comprises an air channel which is led parallel to the transporting channel for drinking liquid and up to the mouth end 28, as not illustrated in FIG. 23*c*. If the drinking beaker is used as illustrated in FIG. 23*b*, the drinking liquid is sucked out of the mouth end 28 (see FIG. 23*a*), so that, as was illustrated in FIG. 1, the drinking liquid mixed with air bubbles of aromatized air is sucked. Here too, parallel guidance of the transporting channel 18 for drinking liquid and of the air channel 22 for transporting aromatized air is again conceivable.

A variant of the open drinking vessel represented in FIG. 23*a* could be a shot glass which functions according to the same active principle as the open drinking vessel and, for instance, can also be used for spirits which are to be provided with additional taste aromas.

FIGS. 24*a* and 24*b* present a further embodiment of the invention. The particularity of this embodiment consists in that the head part 14 can be screwed onto any bottle serving as a storage container 12. In head part 14 is permanently installed an aroma container which via an air channel 22 not represented either transports the aromatized air parallel to the transporting channel 18 for drinking liquid up to the mouth end 28 or, in accordance with the schematic presentation in FIG. 1, runs into the transporting channel 18 shortly before the mouth end 28. In the embodiment according to FIGS. 24*a* and 24*b*, a conventional bottle with pure drinking liquid can be used which can be reconfigured as desired by replacing the head part 14 with the suction tube 80 connected to it. This embodiment is particularly advantageous in those regions in which the tap water is not drinkable due to inadequate quality, so that the consumers buy as a drinking liquid pure water which can be modified to any desired taste profiles by means of the bottle top.

A further embodiment of the invention is presented schematically in FIGS. 25*a* and 25*b*. In this embodiment the drinking device 10 according to the invention consists of the storage container 12 designed as an open glass and a drinking straw 82, to be arranged in the storage container, which combines in itself the components and functionality of the suction tube 80, the transporting channel 18 for drinking liquid and, due to the aroma container 20 arranged in a ring shape around the drinking straw, also the air channel 22 for transporting aromatized air. Similarly to the preceding exemplary embodiment using a bottle top, the drinking straw 82 can be combined with any desired storage containers 12, whereby the aroma container 20 is preferably not replaceable but instead permanently connected with the drinking straw.

Finally, FIGS. 26*a* and 26*b* present an embodiment in which the head part 12 shown of the drinking device 10 not presented can be turned upside down while drinking into a position that is familiar to consumers, e.g. from drinking devices using a sports valve. The particularity of the embodiment according to FIGS. 26*a* and 26*b* consists in that neither a suction tube 80 nor a drinking straw 82 is required. Without these elements the drinking system according to the invention is easier to handle hygienically. In addition, this embodiment also allows the number of individual components to be reduced, simplifying manufacture and shortening the time required to assemble the system.

Furthermore, the consumer of conventional systems is accustomed to tilting their drinking bottle. In contrast to the exemplary embodiments described above, if used properly the system shown in FIGS. 26*a* and 26*b* does not allow any liquid to be accidentally spilled from the storage container 12. The head part 14 represented in FIGS. 26*a* and 26*b* can be connected with a storage container 12 by means of the thread 84 shown or another means of attachment, although care must be taken to ensure that the connection prevents the escape of liquid. For pressure equalization between the interior and the exterior of the drinking device 10, a check valve 85 can be attached as presented by way of example in FIGS. 4*a* and 4*b*.

In the embodiment presented in FIG. 26*a* the aroma container is represented by way of example as a wide ring 83, the functional principle of which corresponds to the aroma container 20. The aroma container is fluidly connected by means of the air channel 22. Into the opening 86 must be pushed a displaceable mouthpiece, not shown here, which corresponds to a conventional mouthpiece of sports drinking bottles and must be made of a substantially flexible material. The mouthpiece not shown opens and closes the drinking device 10 by being displaced in the direction K.

FIGS. 27*a* and 27*b* show a preferred embodiment of the drinking device according to the invention with a modification of the liquid channel 18 at the mouthpiece 16 in the head part 14 of the drinking device. Through the narrowing 19 shown in FIG. 27*a* or the widening 23 shown in FIG. 27*b* of the channel at the mouthpiece 16, the modification enables a change in the pressure conditions in the liquid-air mixture. The form and size of the air bubbles are modified thereby and a more pleasant drinking sensation is achieved.

A further preferred embodiment of the improvement of the drinking device 10 is presented in FIGS. 28*a* and 28*b*.

The preferred embodiment of the improvement according to the invention provides for the liquid channel 18 in the storage container 12 of the drinking device 10 to be narrower (FIG. 28*a*—number 21) or wider (FIG. 28*b*—number 25). This enables a constant or modified suction pressure with different fill heights of the storage container 12. The required suction pressure is substantially determined by the hydrostatic pressure of the liquid and the frictional loss of the fluid on the wall of the liquid channel 18. According to Pascal's law, the hydrostatic pressure is invariably directly proportional to the fill height in the storage container 12 and influences in a manner noticeable for the drinker the suction pressure to be applied. This negative change can be compensated wholly or in part by modifying the geometry of the liquid channel 18, so that the drinking sensation is improved. In addition, the pressure differences can be reduced through the use, not shown here, of a storage container that is substantially wide yet flat.

A further preferred embodiment, shown in FIG. 29, of the drinking device 10 provides for the air channel 22 in the head part 14 to be narrower only at one place 27, and the air channel otherwise to have a wider cross-section. This has the advantage that despite the necessarily small cross-section, in particular diameter, of the air channel 14, production and cleaning are made easier. For instance, in the embodiment presented by way of example in FIG. 29 liquid coming out of the liquid channel into the air channel 22 can run unhindered back into the liquid channel 18, giving hygienic advantages.

A further preferred embodiment is schematically presented in FIGS. 30*a* and 30*b*. A solution is shown here by way of example in which the head part 14 can be separated into two parts 14*a* and 14*b* substantially along the axis of symmetry. Both parts 14*a*, 14*b* each contain on their inner side a part of the air channel 22 and of the liquid channel 18 which, when the two halves 14*a*, 14*b* are joined together along the direction of arrow C, positively form the channels required for the drinking device. An attachment device 29, which in the preferred embodiment according to FIGS. 30*a* and 30*b* is shown by way of example as a ring, can be reversibly held together by means of a displacement in the direction of arrow D onto the two parts 14*a* and 14*b*. FIG. 30*b* shows the separable head part 14 in the drinking position. Here the recess 66 for the aroma container 20 not shown is likewise designed in cylindrical form. Sealing can be achieved by manufacturing the head part 14 from a substantially flexible material.

A further preferred embodiment of the separable head part 14 is shown in FIG. 31. It is also possible to have the recess 66 for the aroma container 20 in the head part. Integration into the interior of the head part offers the advantage that, when the head part is in the closed state, the aroma container 20 is not visible from the outside, so that the aroma container is less expensive to design, among other benefits, and an evaporation of the aroma substance out of the aroma container during storage is slowed down. The aroma container is inserted by joining together the two parts 14*a* and 14*b* along the direction of arrow E. The two parts of the head part 14 are held together by means of a mechanism not shown here.

A further embodiment for optimizing a drinking device according to the invention is presented by way of example in FIGS. 32*a*, 32*b* and 32*c*. FIG. 32*a* shows a preferred embodiment in which the head part 14 of a drinking device contains a liquid channel 18 and an air channel 22. FIG. 32*a* shows a liquid channel having a uniform shape over the entire length.

By contrast, FIG. 32*b* shows a preferred embodiment of a head part of a drinking device, in which embodiment the liquid channel 18 has a smaller diameter at the place where the liquid channel 18 joins the air channel 22 than at the other places. The flow conditions of the liquid in the liquid channel 18 are thereby changed when the drinking device is used. The narrowing at the point of entry means that the dynamic pressure (impact pressure) there is at its maximum and the static pressure of the liquid at its minimum. The velocity of the liquid rises in proportion to the cross-sections as it flows through the constricted part, since the volume of liquid does not change. At the same time, the pressure in the air channel 22, which is attached at the narrowest point, falls. This creates a pressure difference which increases the absorption of the aromatized air into the liquid of the drinking device. Thus, for instance, the user needs to suck less strongly on the drinking device, so that the drinking sensation is improved. This effect, known as the venturi effect, substantially improves the drinking device.

A further preferred embodiment is shown by way of example in FIG. 32*c* and provides for a liquid channel 18 and an air channel 22 to be arranged in the head part 14 of the drinking device, whereby at the point where the two channels connect at least one of the two channels has a wider cross-section than the other areas of the respective channels. This, too, enables a different drinking sensation for the user of the drinking device.

A further preferred embodiment of the head part 14 is shown by way of example in FIGS. 33*a* and 33*b* and provides for the air channel 22 to be interrupted by a chamber 87 designed substantially as a recess in the outer wall of the liquid channel 18. The interruption of the air channel by a chamber 87 is configured in that a recess is provided in the head part 14 of the drinking device at the place where the detachable transporting channel 18 for the drinking liquid (liquid channel) and the air channel 22 come into contact. In the embodiment shown by way of example, the air channel 22 from the aroma container 20 runs into the chamber 87 at a position located above. On the opposite side the air channel is continued as a channel 22*b* through the transporting channel 18 at a position of the chamber 87 that is located at the bottom. The chamber configured in such a manner prevents the drinking liquid from flowing back into the aroma container 20. The opposite position of the continuation of the air channel 22 allows the chamber 87 to be used in the best possible way. The different height positions of the inlet and outlet opening of the air channel 22 into and out of the chamber 87 enable, among other things, the drainage of drinking liquid back into the transporting channel 18 for drinking liquid. The arrangement of the chamber 87 at the place where the head part 14, which can for example be made from a substantially elastic material, comes into contact with the transporting channel 18 for drinking liquid makes it easier to clean the components after they have been separated. Furthermore, FIGS. 33*a* and 33*b* show the air supply line 32 through the head part 14 into the storage container 12, not shown, for drinking liquid. FIG. 33*b* shows the embodiment of the head part 14 of the drinking device according to FIG. 33*a* in a sectional view, thereby illustrating the positions of the chamber 87, the inlet point of the air channel 22 and the outlet point from the chamber 87 into the continuation of the air channel 22*b*.

Common to all embodiments is that the aroma is only perceived orally, so no orthonasal olfactory impression arises. Through the oral perception of the aroma, the taste impression is created in the user solely through the retronasal perception of the aroma substance and is only perceived by the consumer via the enteral route in negligible quantities, if at all. Even complex aromas and aroma mixtures which do not require long-term stabilization in the drinking liquid and also cannot be swallowed by the user can be created.

The invention claimed is:

1. A drinking device for the retronasal perception of an aroma substance, the drinking device comprising:

a storage container configured for drinking liquid;

at least one air-permeable aroma container;

a transporting channel configured to transport drinking liquid running from the storage container to a mouth end of the drinking device; and an air channel configured to transport aromatized air, the air channel running from at least one of the at least one aroma containers to the transporting channel.

2. A drinking device for the retronasal perception of an aroma substance, the drinking device comprising:

a storage container configured for drinking liquid;

at least one air-permeable aroma container;

a transporting channel configured to transport drinking liquid running from the storage container to a mouth end of the drinking device; and an air channel configured to transport aromatized air, the air channel running from at least one of the at least one aroma containers to the transporting channel or to the mouth end, wherein one of the at least one aroma containers has a sealing device, the aroma container configured to be moved from a sealing position into a non-sealing position.

3. The drinking device according to claim 2, wherein the mouth end is configured such that, when the drinking device is used, the transporting channel and the air channel extend different distances into the oral cavity of the user.

4. The drinking device according to claim 1, further comprising a throttle device and/or a sealing device.

5. The drinking device according to claim 4, wherein one of the at least one aroma containers has the sealing device, the aroma container configured to be moved from a sealing position into a non-sealing position.

6. The drinking device according to claim 1, wherein at least one of the at least one aroma containers comprises multiple chambers.

7. The drinking device according to claim 1, wherein one of the at least one aroma containers is located in a mouthpiece of the drinking device, the mouthpiece being replaceable.

8. The drinking device according to claim 1, further comprising a pressure equalization valve configured to seal an air supply line which leads into the interior of the storage container for drinking liquid.

9. The drinking device according to claim 1, further comprising a head part which comprises the mouth end and is moveably arranged relative to the storage container, the head part configured to be moved from a position sealing the transporting channel and/or the air channel into a non-sealing position.

10. The drinking device according to claim 1, wherein the at least one aroma container comprises a filter substance and an aroma unit which is configured to be activated by the user and which contains a fluid with an aromatizing substance, the fluid being releasable into the filter substance upon activation of the aroma unit.

11. The drinking device according to claim 1, wherein the air channel comprises an annular chamber which is arranged between a detachable head part of the drinking device and the transporting channel.

12. The drinking device according to claim 1, wherein the air channel has a minimum cross-section area of between 0.2 $mm^2$ and 4.9 $mm^2$.

13. The drinking device according to claim 1, further comprising a permeable membrane in the air channel at the point at which the air channel enters the transporting channel.

14. The drinking device according to claim 4, wherein the throttle device and/or the sealing device is-in a mouthpiece comprising the mouth end.

15. The drinking device according to claim 14, wherein the mouthpiece is configured to be moved from a sealing position into a non-sealing position.

16. The drinking device according to claim 6, wherein the multiple chambers contain aroma substances of different odor intensities and/or different aromas.

17. The drinking device according to claim 2, wherein the mouth end is configured with the transporting channel and the air channel running separated from one another at the mouth end and substantially the same distance in a longitudinal direction.

18. A drinking device for the retronasal perception of an aroma substance, the drinking device comprising:

a storage container configured for drinking liquid;

at least one air-permeable aroma container;

a transporting channel configured to transport drinking liquid running from the storage container to a mouth end of the drinking device;

an air channel configured to transport aromatized air, the air channel running from at least one of the at least one aroma containers to the transporting channel or to the mouth end; and a pressure equalization valve configured to seal an air supply line which leads into the interior of the storage container for drinking liquid.

19. The drinking device according to claim 1, wherein the at least one aroma container is removable from the drinking device.

* * * * *